US010473124B2

(12) United States Patent
Theodossiou

(10) Patent No.: US 10,473,124 B2
(45) Date of Patent: Nov. 12, 2019

(54) SYSTEM FOR INTEGRATING VALVES AND FLOW MANIFOLD INTO HOUSING OF PRESSURE EXCHANGER

(71) Applicant: Energy Recovery, Inc., San Leandro, CA (US)

(72) Inventor: Alexander Patrick Theodossiou, San Francisco, CA (US)

(73) Assignee: ENERGY RECOVERY, INC., San Leandro, CA (US)

( * ) Notice: Subject to any disclaimer, the term of this patent is extended or adjusted under 35 U.S.C. 154(b) by 156 days.

(21) Appl. No.: 15/494,860

(22) Filed: Apr. 24, 2017

(65) Prior Publication Data

US 2017/0306987 A1 Oct. 26, 2017

Related U.S. Application Data

(60) Provisional application No. 62/326,892, filed on Apr. 25, 2016.

(51) Int. Cl.

| | |
|---|---|
| ***F15B 3/00*** | (2006.01) |
| ***F04F 13/00*** | (2009.01) |
| ***E21B 43/12*** | (2006.01) |

(52) U.S. Cl.

CPC ..... *F15B 3/00* (2013.01); *E21B 43/126* (2013.01); *F04F 13/00* (2013.01)

(58) Field of Classification Search

CPC ..... F15B 3/00; F04F 13/00

See application file for complete search history.

(56) References Cited

U.S. PATENT DOCUMENTS

2007/0137170 A1* 6/2007 Bross ..... F04F 13/00 60/39.45
2014/0128655 A1* 5/2014 Arluck ..... C07C 7/11 585/860
2015/0369226 A1* 12/2015 Liao ..... F04B 39/10 417/443
2016/0032702 A1 2/2016 Gay et al.

FOREIGN PATENT DOCUMENTS

DE 2919400 A1 * 11/1980 ..... F02B 33/42
DE 2919400 A1 11/1980

OTHER PUBLICATIONS

PCT International Search Report and Written Opinion; Application No. PCT/US2017/029298; dated Sep. 15, 2017; 17 pages.
PCT International Search Report & Written Opinion for PCT Application No. PCT/US2017/029298 dated Jul. 24, 2017; 13 Pages.

* cited by examiner

*Primary Examiner* — Bryan M Lettman
(74) *Attorney, Agent, or Firm* — Fletcher Yoder, P.C.

(57) ABSTRACT

A system includes an isobaric pressure exchanger (IPX) configured to couple to a manifold. The IPX is also configured to exchange pressure within the IPX between a first fluid at a first pressure and a second fluid at a second pressure. The IPX also includes a housing and at least one manifold connector disposed within the housing that is configured to couple the IPX to the manifold.

15 Claims, 18 Drawing Sheets

20
40
42
44
46
48
50
52
54
56
58
60
62
64
66
68
70
72
74
76
78
80
81
83
85
87

SYSTEM FOR INTEGRATING VALVES AND FLOW MANIFOLD INTO HOUSING OF PRESSURE EXCHANGER

CROSS-REFERENCE TO RELATED APPLICATIONS

This application is a non-provisional of U.S. Provisional Patent Application No. 62/326,892, entitled "SYSTEM FOR INTEGRATING VALVES AND FLOW MANIFOLD INTO HOUSING OF PRESSURE EXCHANGER", filed Apr. 25, 2016, which is herein incorporated by reference in its entirety.

BACKGROUND

This section is intended to introduce the reader to various aspects of art that may be related to various aspects of the present subject matter, which are described and/or claimed below. This discussion is believed to be helpful in providing the reader with background information to facilitate a better understanding of the various aspects of the present subject matter. Accordingly, it should be understood that these statements are to be read in this light, and not as admissions of prior art.

The subject matter disclosed herein relates to fluid handling, and, more particularly, to systems and methods for fluid handling using an isobaric pressure exchanger (IPX).

A variety of fluids may be used in the extraction of hydrocarbons from the earth. For example, hydraulic fracturing may refer to the fracturing of rock by a pressurized liquid, which may be referred to as a fracing fluid. The use of fracing fluids for hydraulic fracturing may increase the production of hydrocarbons from certain reservoirs. Typically, the fracing fluid may be introduced into the wellbore of a hydrocarbon reservoir at very high pressures by using high-pressure, high-volume pumps. Unfortunately, these pumps may undergo accelerated wear and erosion because of the properties of the fracing fluid and/or certain components of the fracing fluid, which may increase the cost to operate the pumps and/or decrease the efficiency of the hydraulic fracturing operation.

BRIEF DESCRIPTION OF THE DRAWINGS

Various features, aspects, and advantages of the present subject matter will become better understood when the following detailed description is read with reference to the accompanying figures in which like characters represent like parts throughout the figures, wherein.

DETAILED DESCRIPTION OF SPECIFIC EMBODIMENTS

Figure 1:
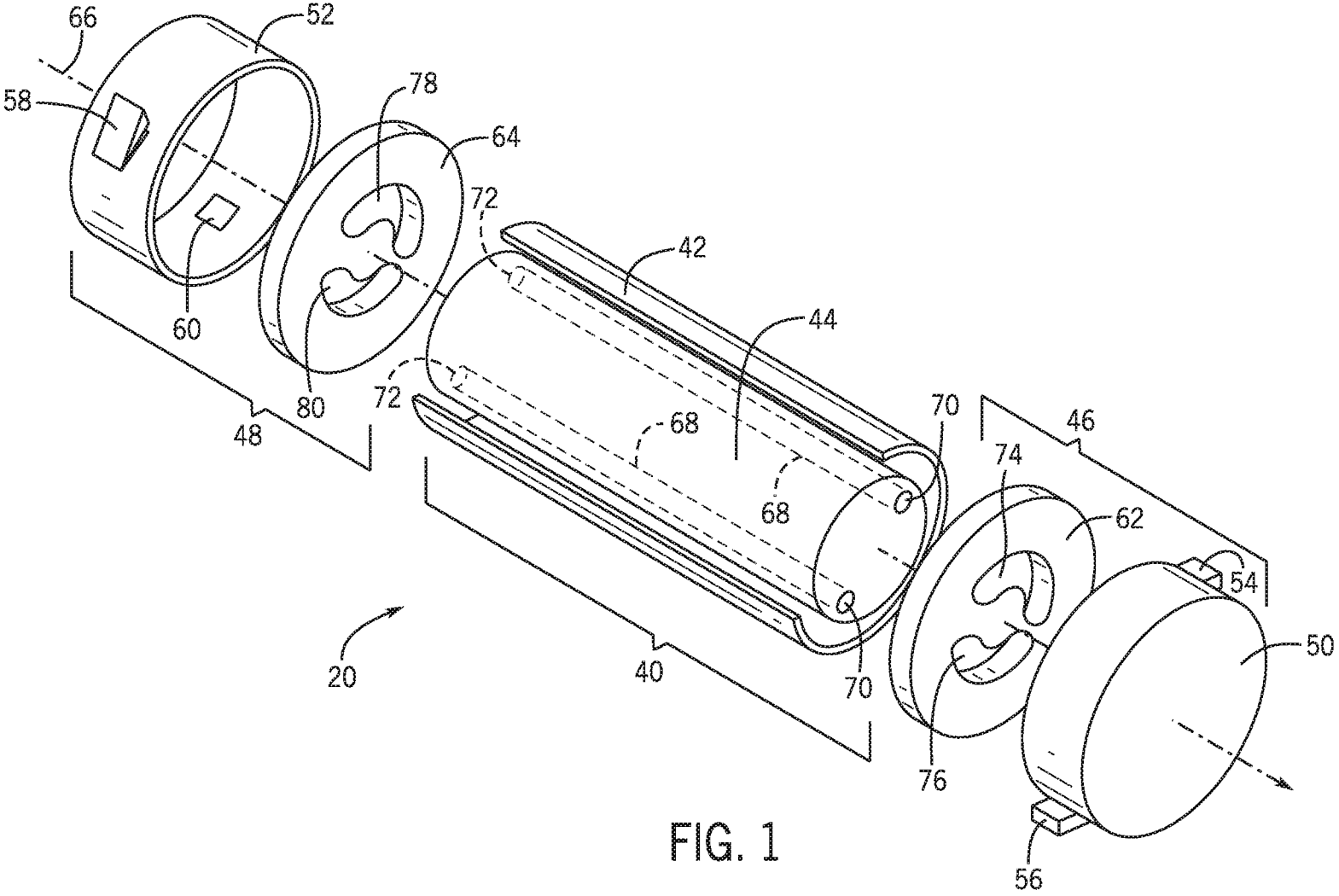
FIG. 1 is an exploded perspective view of an embodiment of a rotary isobaric pressure exchanger (IPX)

One or more specific embodiments of the present subject matter will be described below. These described embodiments are only exemplary of the present subject matter. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments relate generally to rotating equipment, and particularly to an isobaric pressure exchanger (IPX). For example, the IPX may handle a variety of fluids, some of which may be more viscous and/or abrasive than others. For example, the IPX can handle multi-phase (e.g., having at least two phases, where a phase is a region of space throughout which all physical properties of a material are essentially uniform) fluid flows, such as particle-laden liquid flows. An example of such a fluid includes, but is not limited to, the fracing fluid used in hydraulic fracturing. The fracing fluid may include water mixed with chemicals and small particles of hydraulic fracturing proppants, such as sand or aluminum oxide. The IPX may include chambers wherein the pressures of two volumes of a liquid may equalize, as described in detail below. In some embodiments, the pressures of the two volumes of liquid may not completely equalize. Thus, the IPX may not only operate isobarically, but also substantially isobarically (e.g., wherein the pressures equalize within approximately +/−1, 2, 3, 4, 5, 6, 7, 8, 9, or 10 percent of each other). In certain embodiments, a first pressure of a first fluid may be greater than a second pressure of a second fluid. For example, the first pressure may be between approximately 130 MPa to 160 MPa, 115 MPa to 180 MPa, or 100 MPa to 200 MPa greater than the second pressure. Thus, the IPX may be used to transfer pressure from the first fluid to the second fluid.

In certain situations, it may be desirable to use the IPX with viscous and/or abrasive fluids, such as fracing fluids. Specifically, the IPX or a plurality of IPXs may be used to handle these fluids instead of other equipment, such as the high-pressure, high-volume pumps used to inject fracing fluids into hydrocarbon reservoirs of other hydraulic fracturing operations. When used to pump fracing fluids, these high-pressure, high-volume pumps, which may be positive displacement pumps, may experience high rates of wear and erosion, resulting in short lives and high maintenance costs. In contrast, the components of the IPX may be more resistant to the effects of fracing fluids. Thus, in certain embodiments, the high-pressure, high-volume pumps may be used to pressurize a less viscous and/or less abrasive fluid, such as water (e.g., having a single phase), which is then used by the IPX to transfer pressure to the fracing fluid. In other words, the high-pressure, high-volume pumps of the present embodiments do not handle the pumping of the fracing fluids. Use of such embodiments may provide several advantages compared to other methods of handling fracing fluids. For example, such embodiments may help extend the life and/or reduce the operating costs of the high-pressure, high-volume pumps. By reducing downtime associated with the high-pressure, high-volume pumps, which may be very costly, the overall hydrocarbon production rate may be increased by increasing the life of the high-pressure pumps. In certain embodiments, an integrated manifold system (e.g., integrated pressure exchange manifold) may include a plurality of IPXs and one or more piping manifolds for handling the fracing fluid and/or water, which may be easily integrated with the high-pressure, high-volume pumps and other equipment associated with hydraulic fracturing operations. Specifically, such embodiments of the integrated manifold system may include a plurality of connections to interface with existing piping, hoses, and/or other equipment. These embodiments of the integrated manifold system may have a relatively small footprint, thereby reducing any added congestion to what may already be a congested hydraulic fracturing operation. In addition, the integrated manifold system may help simplify the operation of the hydraulic fracturing operation. Specifically, by placing numerous components, such as the plurality of IPXs and manifolds, on a single trailer, the complexity associated with handling and connecting the integrated manifold system to other components of the hydraulic fracturing operation may be reduced. In other words, the number of trailers or skids associated with the components of the integrated manifold system may be reduced to a single trailer. Thus, use of the disclosed embodiments may increase the hydrocarbon production rates of hydraulic fracturing operations while also decreasing costs associated with these operations.

FIG. 1 is an exploded view of an embodiment of a rotary IPX 20 that may be modified for use with viscous and/or abrasive fluids, such as fracing fluids. As used herein, the isobaric pressure exchanger (IPX) may be generally defined as a device that transfers fluid pressure between a high-pressure inlet stream and a low-pressure inlet stream at efficiencies in excess of approximately 50%, 60%, 70%, or 80% without utilizing centrifugal technology. In this context, high pressure refers to pressures greater than the low pressure. The low-pressure inlet stream of the IPX may be pressurized and exit the IPX at high pressure (e.g., at a pressure greater than that of the low-pressure inlet stream), and the high-pressure inlet stream may be depressurized and exit the IPX at low pressure (e.g., at a pressure less than that of the high-pressure inlet stream). Additionally, the IPX may operate with the high-pressure fluid directly applying a force to pressurize the low-pressure fluid, with or without a fluid separator between the fluids. Examples of fluid separators that may be used with the IPX include, but are not limited to, pistons, bladders, diaphragms and the like. In certain embodiments, isobaric pressure exchangers may be rotary devices. Rotary isobaric pressure exchangers (IPXs) 20, such as those manufactured by Energy Recovery, Inc. of San Leandro, Calif., may not have any separate valves, since the effective valving action is accomplished internal to the device via the relative motion of a rotor with respect to end covers, as described in detail below with respect to FIGS. 1-5. Rotary IPXs may be designed to operate with internal pistons to isolate fluids and transfer pressure with little mixing of the inlet fluid streams. Reciprocating IPXs may include a piston moving back and forth in a cylinder for transferring pressure between the fluid streams. Any IPX or plurality of IPXs may be used in the disclosed embodiments, such as, but not limited to, rotary IPXs, reciprocating IPXs, or any combination thereof. While the discussion with respect to certain embodiments of the integrated manifold system may refer to rotary IPXs, it is understood that any IPX or plurality of IPXs may be substituted for the rotary IPX in any of the disclosed embodiments. In addition, the IPX may be disposed on a skid separate from the other components of a fluid handling system, which may be desirable in situations in which the IPX is added to an existing fluid handling system.

In the illustrated embodiment of FIG. 1, the rotary IPX 20 may include a generally cylindrical body portion 40 that includes an annular portion or sleeve 42 and a rotor 44 disposed within the annular portion 42. The rotor 44 may be used with the integrated manifold system, as described in detail below with respect to FIGS. 6-9. The rotary IPX 20 may also include two end structures or end caps 46 and 48 that include manifolds 50 and 52, respectively. Manifold 50 includes inlet and outlet ports 54 and 56 and manifold 52 includes inlet and outlet ports 60 and 58. For example, inlet port 54 may receive a high-pressure first fluid and the outlet port 56 may be used to route a low-pressure first fluid away from the IPX 20. Similarly, inlet port 60 may receive a low-pressure second fluid and the outlet port 58 may be used to route a high-pressure second fluid away from the IPX 20. The end structures 46 and 48 may include generally flat end plates 62 and 64 (or end covers), respectively, disposed within the manifolds 50 and 52, respectively, and adapted for liquid sealing contact with the rotor 44. The rotor 44 may be cylindrical and disposed in the annular portion 42, and is arranged for rotation about a longitudinal axis 66 of the rotor 44. The rotor 44 may have a plurality of channels 68 extending substantially longitudinally through the rotor 44 with openings 70 and 72 at each end arranged symmetrically about the longitudinal axis 66. The openings 70 and 72 of the rotor 44 are arranged for hydraulic communication with the end plates 62 and 64, and inlet and outlet apertures 74 and 76, and 78 and 80, in such a manner that during rotation they alternately hydraulically expose liquid at high pressure and liquid at low pressure to the respective manifolds 50 and 52. The inlet and outlet ports 54, 56, 58, and 60, of the manifolds 50 and 52 form at least one pair of ports for high-pressure liquid in one end element 46 or 48, and at least one pair of ports for low-pressure liquid in the opposite end element, 48 or 46. The end plates 62 and 64, and inlet and outlet apertures 74 and 76, and 78 and 80 are designed with perpendicular flow cross sections in the form of arcs or segments of a circle.

With respect to the IPX 20, the plant operator has control over the extent of mixing between the first and second fluids, which may be used to improve the operability of the fluid handling system. For example, varying the proportions of the first and second fluids entering the IPX 20 allows the plant operator to control the amount of fluid mixing within the fluid handling system. Three characteristics of the IPX 20 that affect mixing are: the aspect ratio of the rotor channels 68, the short duration of exposure between the first and second fluids, and the creation of a liquid barrier (e.g., an interface) between the first and second fluids within the rotor channels 68. First, the rotor channels 68 are generally long and narrow, which stabilizes the flow within the IPX 20. In addition, the first and second fluids may move through the channels 68 in a plug flow regime with very little axial mixing. Second, in certain embodiments, at a rotor speed of approximately 1200 RPM, the time of contact between the first and second fluids may be less than approximately 0.15 seconds, 0.10 seconds, or 0.05 seconds, which again limits mixing of the streams 18 and 30. Third, a small portion of the rotor channel 68 is used for the exchange of pressure between the first and second fluids. Therefore, a volume of fluid remains in the channel 68 as a barrier between the first and second fluids. All these mechanisms may limit mixing within the IPX 20.

In addition, because the IPX 20 is configured to be exposed to the first and second fluids, certain components of the IPX 20 may be made from materials compatible with the components of the first and second fluids. In addition, certain components of the IPX 20 may be configured to be physically compatible with other components of the fluid handling system. For example, the ports 54, 56, 58, and 60 may comprise flanged connectors to be compatible with other flanged connectors present in the piping of the fluid handling system. In other embodiments, the ports 54, 56, 58, and 60 may comprise threaded or other types of connectors.

FIGS. 2-5 are exploded views of an embodiment of the rotary IPX 20 illustrating the sequence of positions of a single channel 68 in the rotor 44 as the channel 68 rotates through a complete cycle, and are useful to an understanding of the rotary IPX 20. It is noted that FIGS. 2-5 are simplifications of the rotary IPX 20 showing one channel 68 and the channel 68 is shown as having a circular cross-sectional shape. In other embodiments, the rotary IPX 20 may include a plurality of channels 68 (e.g., 2 to 100) with different cross-sectional shapes. Thus, FIGS. 2-5 are simplifications for purposes of illustration, and other embodiments of the rotary IPX 20 may have configurations different from that shown in FIGS. 2-5. As described in detail below, the rotary IPX 20 facilitates a hydraulic exchange of pressure between two liquids by putting them in momentary contact within a rotating chamber. In certain embodiments, this exchange happens at a high speed that results in very high efficiency with very little mixing of the liquids.

Figures 2, 3, 4, 5:
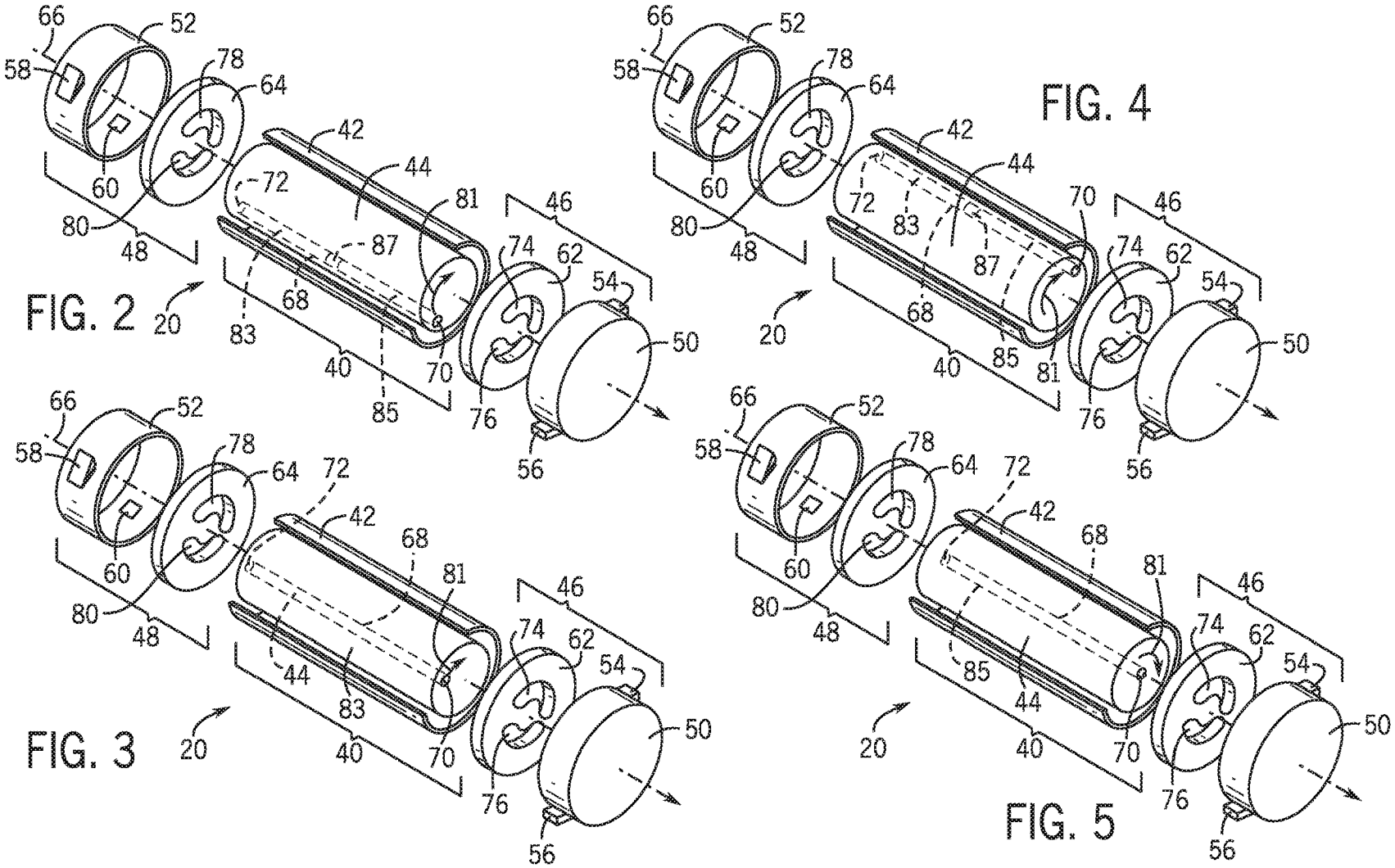
FIG. 2 is an exploded perspective view of an embodiment of a rotary IPX in a first operating position.
FIG. 3 is an exploded perspective view of an embodiment of a rotary IPX in a second operating position.
FIG. 4 is an exploded perspective view of an embodiment of a rotary IPX in a third operating position.
FIG. 5 is an exploded perspective view of an embodiment of a rotary IPX in a fourth operating position.

In FIG. 2, the channel opening 70 is in hydraulic communication with aperture 76 in endplate 62 and therefore with the manifold 50 at a first rotational position of the rotor 44 and opposite channel opening 72 is in hydraulic communication with the aperture 80 in endplate 64, and thus, in hydraulic communication with manifold 52. As discussed below, the rotor 44 rotates in the clockwise direction indicated by arrow 81. As shown in FIG. 2, low-pressure second fluid 83 passes through end plate 64 and enters the channel 68, where it pushes first fluid 85 out of the channel 68 and through end plate 62, thus exiting the rotary IPX 20. The first and second fluids 83 and 85 contact one another at an interface 87 where minimal mixing of the liquids occurs because of the short duration of contact. The interface 87 is a direct contact interface because the second fluid 83 directly contacts the first fluid 85.

In FIG. 3, the channel 68 has rotated clockwise through an arc of approximately 90 degrees, and outlet 72 is now blocked off between apertures 78 and 80 of end plate 64, and outlet 70 of the channel 68 is located between the apertures 74 and 76 of end plate 62 and, thus, blocked off from hydraulic communication with the manifold 50 of end structure 46. Thus, the low-pressure second fluid 83 is contained within the channel 68.

In FIG. 4, the channel 68 has rotated through approximately 180 degrees of arc from the position shown in FIG. 2. Opening 72 is in hydraulic communication with aperture 78 in end plate 64 and in hydraulic communication with manifold 52, and the opening 70 of the channel 68 is in hydraulic communication with aperture 74 of end plate 62 and with manifold 50 of end structure 46. The liquid in channel 68, which was at the pressure of manifold 52 of end structure 48, transfers this pressure to end structure 46 through outlet 70 and aperture 74, and comes to the pressure of manifold 50 of end structure 46. Thus, high-pressure first fluid 85 pressurizes and displaces the second fluid 83.

In FIG. 5, the channel 68 has rotated through approximately 270 degrees of arc from the position shown in FIG. 2, and the openings 70 and 72 of channel 68 are between apertures 74 and 76 of end plate 62, and between apertures 78 and 80 of end plate 64. Thus, the high-pressure first fluid 85 is contained within the channel 68. When the channel 68 rotates through approximately 360 degrees of arc from the position shown in FIG. 2, the second fluid 83 displaces the first fluid 85, restarting the cycle.

Figure 6:
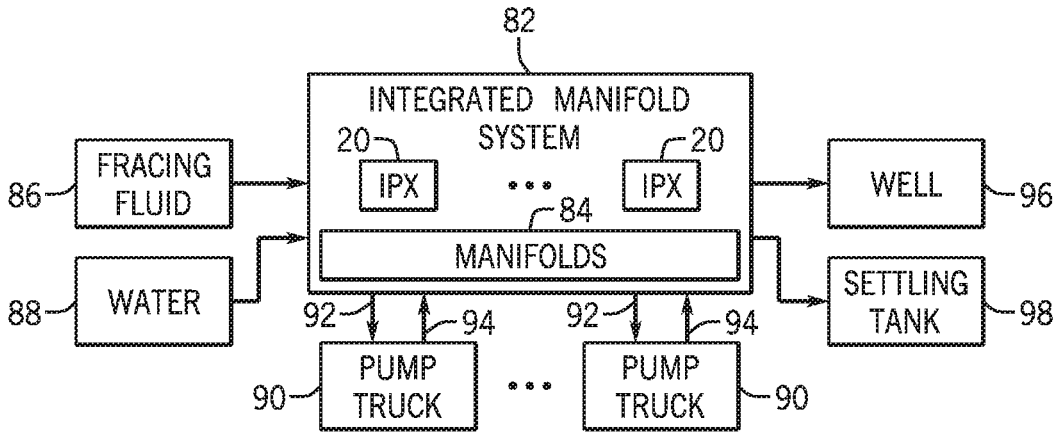
FIG. 6 is a schematic diagram of an embodiment of an integrated manifold system having a plurality of rotary IPXs that may be used in a hydraulic fracturing operation.

FIG. 6 is a schematic diagram of an embodiment of an integrated manifold system 82 having a plurality of rotary IPXs 20 (e.g., 4 to 20) that may be used in a hydraulic fracturing operation. The integrated manifold system is integrated by having the plurality of rotary IPXs 20 connected to one another via one or more manifolds (e.g., 2 to 20 segments of piping, tubing, conduits, and so forth connected to one another) as one assembly disposed on a skid or trailer that can be easily transported to and from the hydraulic fracturing operation. In certain embodiments, the manifolds may also include valves and other components, such as sensors. Each manifold may handle a separate fluid, such as the water or the fracing fluid, as described in detail below. Although the term water is used in the following discussion, in certain embodiments, any clean fluid (e.g., fluid substantially free of debris or solids or with substantially less debris or solids than the fracing fluid) may be used instead of water. In certain embodiments, water may also be referred to as "slick-water". Clean fluid may also include what is known in the industry as linear, cross-linked or hybrid Gel which could be water-based or oil-based. In certain embodiments, water may be combined with one or more of an oil, an acid, and a gelling agent. In addition, although the term fracing fluid is used in the following discussion, in certain embodiments, any fluid used in the production of oil and gas may be used instead of fracing fluid. Although the following discussion focuses on the use of the integrated manifold system 82 for hydraulic fracturing, certain embodiments of the integrated manifold system 82 may be used in similar applications in other oil and gas operations, mining operations, and so forth. As shown in FIG. 6, the plurality of rotary IPXs 20 (as indicated by horizontal dots) may be disposed within the integrated manifold system 82, which may include one or more manifolds 84 for handling water and/or fracing fluid, as described in detail below. Specifically, each of the rotary IPXs 20 may transfer pressure from a clean fluid (e.g., water) to the fracing fluid (e.g., mixture of water, chemicals, and proppant). The integrated manifold system 82 may be coupled to various components of the hydraulic fracturing operation. For example, fracing fluid 86 (e.g., first fluid) and water 88 (e.g., second fluid) may be supplied to the integrated manifold system 82 via tanks, vessels, pumps, blenders, conduits, pipes, hoses, and so forth. In addition, one or more pump trucks 90 (as indicated by horizontal dots) may be coupled to the integrated manifold system 82. Each pump truck 90 may include one or more high-pressure, high-volume pumps, such as positive displacement or plunger pumps. The pump trucks may be easily moved from one hydraulic fracturing site to another. As shown in FIG. 6, each pump truck may include an inlet connection 92 and an outlet connection 94 to provide a fluid, such as water, to the integrated manifold system 82 at a high pressure and high volume. As described below, by using the pump trucks 90 to handle water instead of the fracing fluid, the lives of the pump trucks 90 (e.g., particularly the high-pressure pumps) may be extended and operating costs reduced because the pump trucks 90 (e.g., particularly the high-pressure pumps) handle clean fluid (e.g. water) instead of the viscous and/or abrasive fracing fluid in the disclosed embodiments. As described in detail below, the rotary IPXs 20 may be used to transfer pressure from the high pressure clean fluid (e.g. water) produced by the pump trucks 90 to the fracing fluid. Thus, high-pressure, high-volume fracing fluid from the rotary IPXs 20 may be transferred to the well 96 or wellbore from the integrated manifold system 82 via conduits, pipes, hoses, and so forth. The low-pressure clean fluid (e.g. water) from the rotary IPXs 20, after transferring its energy to frac fluid, may be transferred to a settling tank 98 to allow any solids or other materials to settle out of the water, before the water is recycled to the integrated manifold system 82 to be reused. In addition, the settling tank 98 may allow for heat generated by the pump trucks 90 to be dissipated. In other embodiments, the water from the settling tank 98 may be used in other areas of the hydraulic fracturing operation. In some embodiments, the water from the integrated manifold system 82 may be returned to a cooling pond, lake, river, or similar reservoir.

In certain embodiments, a method or process may be implemented for operating the integrated manifold system 82. Specifically, fracing fluid and water may be supplied to the integrated manifold system 82. Next, water may be pressurized by the plurality of pump trucks 90 and delivered to the plurality of rotary IPXs 20, where pressure from the high-pressure water is transferred to the fracing fluid. The high-pressure fracing fluid may be delivered from the integrated manifold system 82 to the well 96 and the low-pressure water returned to a settling tank 98.

Figure 7:
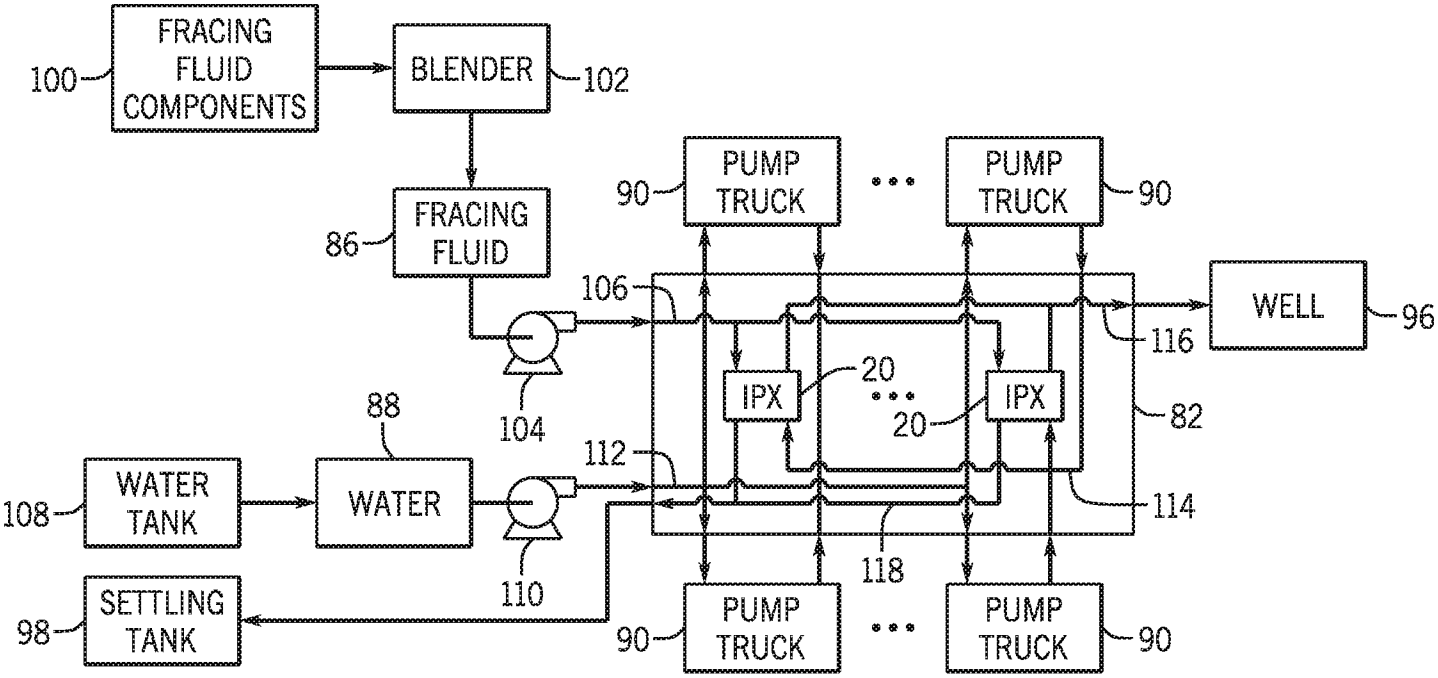
FIG. 7 is schematic diagram of an embodiment of an integrated manifold system having a plurality of rotary IPXs and both water and fracing fluid manifolds that may be used in a hydraulic fracturing operation.

FIG. 7 is schematic diagram of an embodiment of the integrated manifold system 82 having a plurality of rotary IPXs 20 and both water and fracing fluid manifolds that may be used in a hydraulic fracturing operation. As described in detail below, the integrated manifold system 82 may include the IPXs 20 and various manifolds, and may be disposed on a mobile transport unit (e.g., a trailer) to be easily transported to and from the hydraulic fracturing operation (i.e., to different locations). The various connections to and from the integrated manifold system 82 may be made using various conduits, pipes, hoses, and similar connections used in the hydraulic fracturing operation. As shown in FIG. 7, various fracing fluid components 100, such as, but not limited to, water (e.g., provided by the water tank or from the low-pressure water discharged from the IPXs 20), proppants, sand, ceramics, gelling agents, gels, foams, compressed gases, propane, liquefied petroleum gas, and various other chemical additives, may be supplied to a blender 102 to mix the components together to produce the fracing fluid 86. Thus, the fracing fluid 86 may be characterized as a two-phase (e.g., liquid and solid) fluid. In other embodiments, the blender 102 may be omitted and the various fracing fluid components 100 may arrive at the hydraulic fracturing operation already mixed together as the fracing fluid 86. As shown in FIG. 7, a fracing fluid pump 104, such as a centrifugal pump or other type of pump (e.g., reciprocating pump), may be used to transfer the fracing fluid 86 to the integrated manifold system 82. The fracing fluid 86 may arrive at the integrated manifold system 82 at a pressure between approximately 675 kPa and 1,400 kPa. The integrated manifold system 82 may include a low-pressure fracing fluid manifold 106 to transfer the fracing fluid 86 from the fracing fluid pump 104 to the plurality of rotary IPXs 20. Specifically, the low-pressure fracing fluid manifold 106 (e.g., one pipe, conduit or tubing or several segments coupled together) may be a conduit or other pipe with branches to each of the rotary IPXs 20.

As illustrated in FIG. 7, water 88 (e.g., clean fluid) may be supplied from a water tank 108, vessel, or other reservoir to a water pump 110 that transfers the water 88 to the integrated manifold system 82. In certain embodiments, the water pump 110 may be a centrifugal pump or another type of pump (e.g., reciprocating pump). The integrated manifold system 82 may include an inlet water manifold 112 to transfer the water 88 from the water pump 110 to each of the pump trucks 90 via separate connections for each pump truck 90. As shown in FIG. 7, the pump trucks 90 may be arranged along longitudinal or lengthwise sides of the integrated manifold system 82. Thus, the position of the integrated manifold system 82 between rows of pump trucks 90 may help reduce the overall footprint of the hydraulic fracturing operation and/or reduce any reconfiguration of the hydraulic fracturing operation. A plurality of pump trucks 90 may be used to obtain the high volumes, such as volumes between approximately 1500 liters per minute and 22,000 liters per minute, used for the hydraulic fracturing operation. In certain embodiments, the inlet water manifold 112 may be a conduit or other pipe with branches to each of the pump trucks 90. As described above, each pump truck 90 may include one or more high-pressure, high-volume pumps to increase the pressure of the water 88 to a water pressure between approximately 130 MPa to 160 MPa, 115 MPa to 180 MPa, or 100 MPa to 200 MPa greater than a fracing fluid pressure of the fracing fluid 86 from the fracing pump 104. In contrast to other hydraulic fracturing operations, the pump trucks 90 of the disclosed embodiments handle water 88 instead of the fracing fluid 86. In other words, the pump trucks 90 are isolated from the fracing fluid 86. Thus, the pump trucks 90 of the disclosed embodiments are less susceptible to downtime caused by the viscous and/or abrasive fracing fluid 86. Thus, the throughput of the disclosed hydraulic fracturing operations that utilize the integrated manifold system 82 may be increased and operating costs decreased compared to other hydraulic fracturing operations that do not include the integrated manifold system 82 by increasing the life of the high-pressure pumps, which may be very costly. The high-pressure water 88 from the pump trucks 90 returns to the integrated manifold system 82 and enters a high-pressure water manifold 114, which may be a conduit or other pipe with branches to each of the rotary IPXs 20.

As described in detail above, each of the plurality of IPXs 20 transfers pressure from the high-pressure water 88 in the high-pressure water manifold 114 to the fracing fluid 86 in the low-pressure fracing fluid manifold 106. The high-pressure fracing fluid 86 from each of the plurality of IPXs 20 is combined in a high-pressure fracing fluid manifold 116 of the integrated manifold system 82. The high-pressure fracing fluid 86 may be conveyed from the integrated manifold system 82 to the well 96 using conduits, pipes, or hoses. Once introduced into the well 96, the high-pressure fracing fluid 86 may be used to stimulate the production of hydrocarbons from the well 96.

As shown in FIG. 7, the low-pressure water 88 from each of the plurality of IPXs 20 is combined in a low-pressure water manifold 118 of the integrated manifold system 82. The low-pressure water 88 may be conveyed from the integrated manifold system 82 to the settling tank 98 using conduits, pipes, or hoses. As described above, the low-pressure water 88 from the integrated manifold system 82 may be returned to ponds, lakes, basins, or other reservoirs in certain embodiments.

Figure 8:
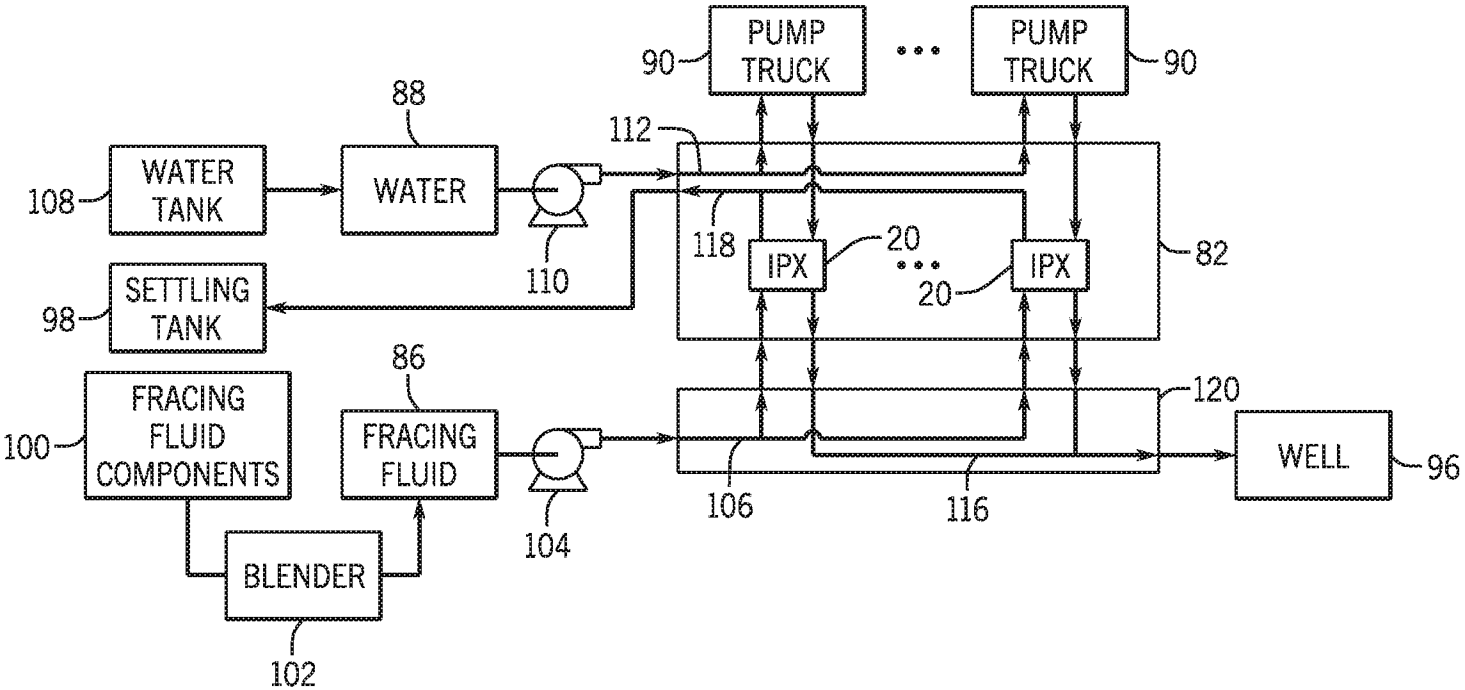
FIG. 8 is schematic diagram of an embodiment of an integrated manifold system having a plurality of rotary IPXs and water manifolds that may be used in a hydraulic fracturing operation.

FIG. 8 is schematic diagram of an embodiment of the integrated manifold system 82 having a plurality of rotary IPXs 20 and water manifolds that may be used in a hydraulic fracturing operation. Certain components of the embodiment shown in FIG. 8 are similar to those shown in FIG. 7. For example, water 88 is supplied to the integrated manifold system 82 using the water pump 110 and returned to the settling tank 98. In addition, the plurality of pump trucks 90 are coupled to the integrated manifold system 82 and used to increase the pressure of the water 88 delivered to the plurality of rotary IPXs 20 disposed in the integrated manifold system 82. However, in certain embodiments, the low-pressure fracing fluid manifold 106 and the high-pressure fracing fluid manifold 116 may be disposed in a manifold trailer 120 (or skid) separate from the integrated manifold system 82 that includes the water manifolds 112, 118. Thus, the fracing fluid 86 from the fracing pump 104 may be delivered initially to the manifold trailer 120. From there, the low-pressure fracing fluid 86 may be transferred to the integrated manifold system 82 via conduits, pipes, hoses, and so forth. Specifically, the low-pressure fracing fluid manifold 106 may include separate branches to each of the plurality of rotary IPXs 20 of the integrated manifold system 82. Similarly, the high-pressure fracing fluid 86 from each of the plurality of rotary IPXs 20 may be delivered via separate branches to the high-pressure fracing fluid manifold 116 of the manifold trailer 120. From there, the high-pressure fracing fluid 86 may be delivered to the well 96. Separating the low-pressure and high-pressure fracing fluid manifolds 106, 116 from the integrated manifold system 82 may provide additional flexibility in the arrangement of equipment at certain hydraulic fracturing operations. In other embodiments, the water 112, 118 and fracing fluid manifolds 106, 116 may be arranged differently. For example, the integrated manifold system 82 may only include the low-pressure and high-pressure fracing fluid manifolds 106, 116 and not the water manifolds 112, 118. In certain embodiments, the fracing fluid manifolds 106, 116 may be disposed on a first trailer, the water manifolds 112, 118 on a second trailer, and the plurality of rotary IPXs 20 on a third trailer. Other arrangements of manifolds and rotary IPXs 20 are possible in further embodiments.

Figure 9:
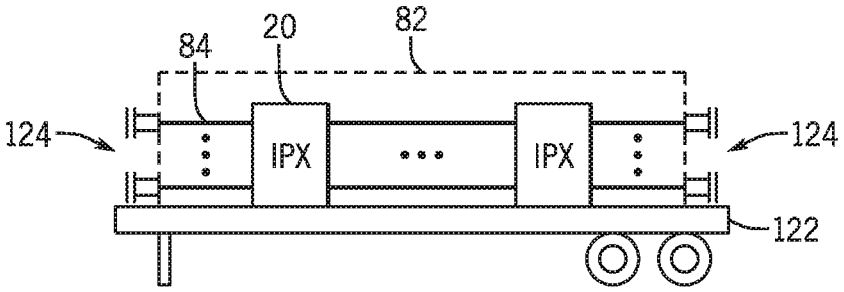
FIG. 9 is a side view of an embodiment of an integrated manifold system having a plurality of rotary IPXs mounted on a trailer.

FIG. 9 is a side view of an embodiment of the integrated manifold system 82 having the plurality of rotary IPXs 20 mounted on a trailer 122 (e.g., mobile transport unit). The integrated manifold system 82 may include any of the embodiments of the integrated manifold system 82 described in detail above. For example, the integrated manifold system 82 may include the plurality of rotary IPXs 20 connected to one another via one or more manifolds (e.g., 2 to 20 segments of piping, tubing, conduits, and so forth connected to one another) as one assembly disposed on the trailer 122. As shown in FIG. 9, the various components of the integrated manifold system 82 are represented as being enclosed by or coupled to the dashed box. In certain embodiments, these components may be surrounded by a physical enclosure to protect the components from the weather and environment. In other embodiments, no enclosure is provided and the various components of the integrated manifold system 82 may be designed to be exposed to the weather and environment. The trailer 122 may be of an appropriate length and weight rating for supporting and transporting the integrated manifold system 82. In addition, one or more connections 124 may be provided to couple to the various manifolds 84 of the integrated manifold system 82. Examples of connections 124 that may be used include, but are not limited to, flanged, screwed, threaded, hammer-union, and so forth. By providing the integrated manifold system 82 on the trailer 122, the integrated manifold system 82 may be easily transported from one hydraulic fracturing operation to another. In addition, by placing the components of the integrated manifold system 82 on the trailer 122, the footprint occupied by the integrated manifold system 82 may be reduced. In other words, the components of the integrated manifold system 82 are concentrated on one trailer 122 compared to being spread out over several trailers or skids. Thus, use of the integrated manifold system 82 may be easily integrated into many existing hydraulic fracturing operations.

Figure 10:
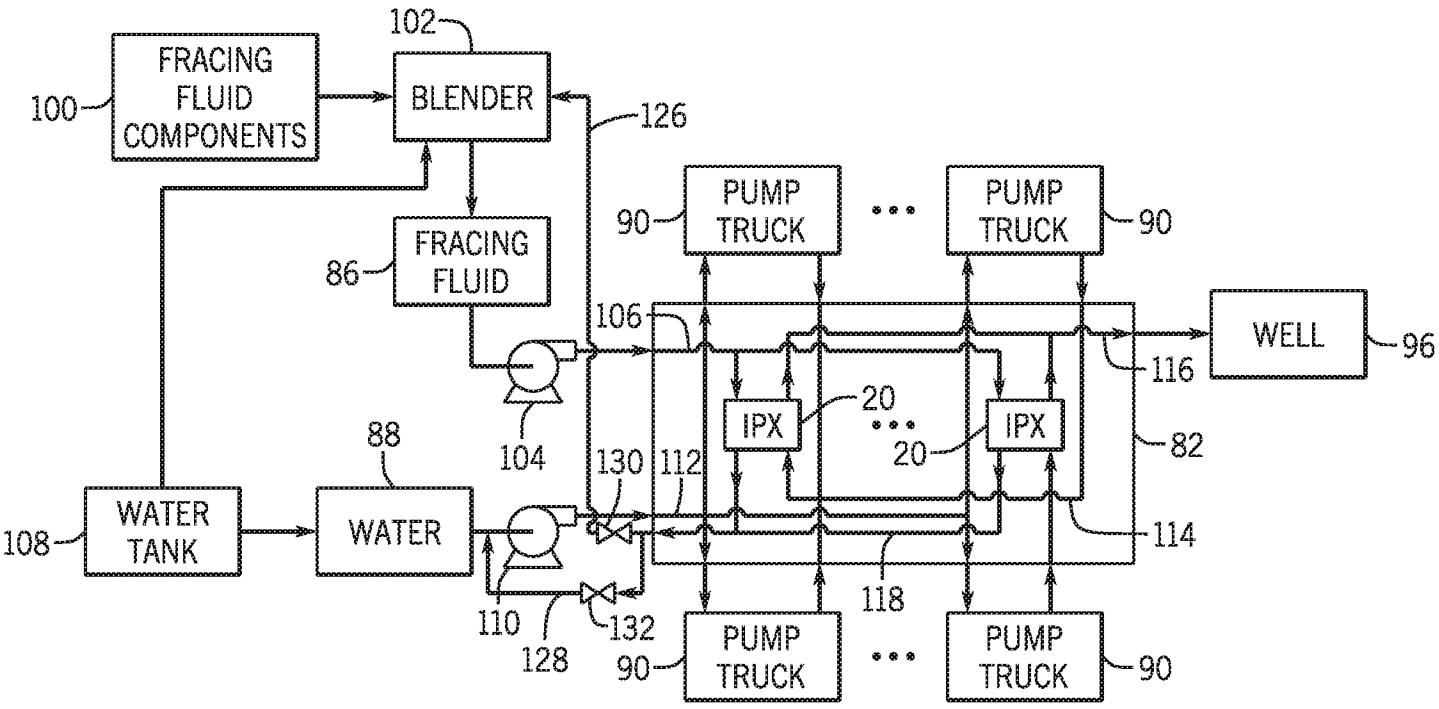
FIG. 10 is a schematic diagram of an embodiment of an integrated manifold system having a plurality of rotary IPXs that may be used in a hydraulic fracturing operation (e.g., returning at least a portion of a discharged low-pressure water to a blender)

FIG. 10 is a schematic diagram of an embodiment of the integrated manifold system 82 having the plurality of rotary IPXs 20 that may be used in a hydraulic fracturing operation (e.g., returning at least a portion of a discharged low-pressure water to the blender 102). In general, the integrated manifold system 82 and components of the associated hydraulic fracturing operation are as described above (e.g., FIG. 7) except the low-pressure water discharged from the rotary IPXs 20 into the low-pressure water manifold 118 is fully or partially directed to the blender 102 to be mixed with the fracing fluid 86 instead of the settling tank 98. For example, the discharged low-pressure water may be directed along fluid conduit 126 to the blender 102 and/or fluid conduit 128 to be returned upstream of the water pump 110 to be transferred to the water inlet manifold 112. As depicted, the fluid conduit conduits 126, 128 each include a respective valve 130, 132 (e.g., fluid control valves) to regulate how much of the discharged low-pressure water is directed to the blender 102. The ratio of discharged low-pressure water diverted to the blender 102 versus upstream of the water pump 110 may depend upon the capacity of the blender (e.g., in order to avoid overflowing the blender 102). In certain embodiments, the percentage of discharged low-pressure water diverted to the blender 102 (as opposed to upstream of the water pump 110) may range from approximately 0 to 100 percent, 0 to 25 percent, 25 to 50 percent, 50 to 75 percent, 75 to 100 percent, and all subranges therebetween. For example, the percentage of discharged low-pressure water diverted to the blender 102 may be approximately 10, 20, 30, 40, 50, 60, 70, 80, 90, or 100 percent.

Figure 11:
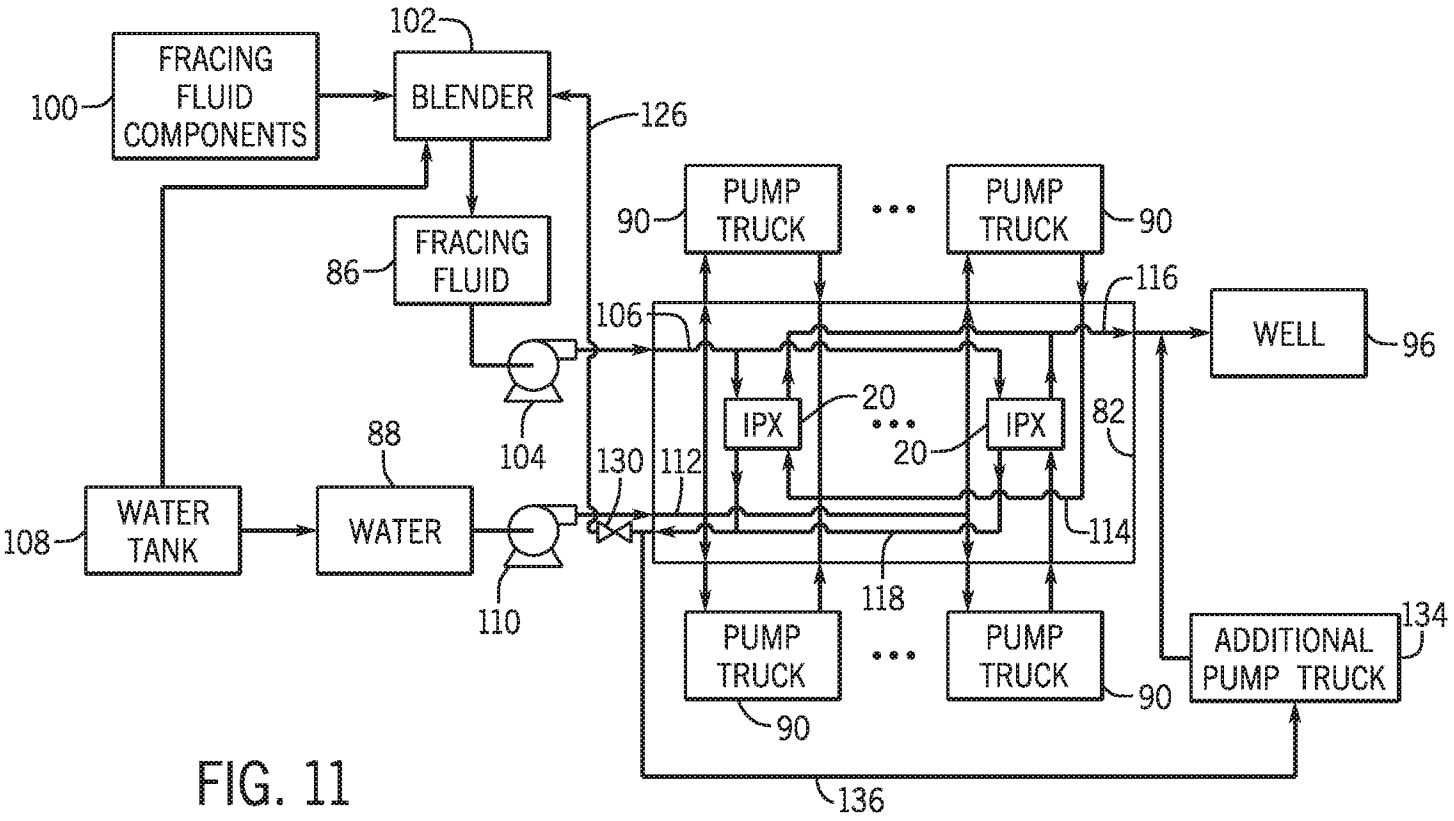
FIG. 11 is a schematic diagram of an embodiment of an integrated manifold system having a plurality of rotary IPXs that may be used in a hydraulic fracturing operation (e.g., repressurizing a portion of a discharge low-pressure water for use in a well)

FIG. 11 is a schematic diagram of an embodiment of the integrated manifold system 82 having the plurality of rotary IPXs 20 that may be used in a hydraulic fracturing operation (e.g., re-pressurizing a portion of a discharge low-pressure second fluid for use in a well). In general, the integrated manifold system 82 and components of the associated hydraulic fracturing operation are as described above (e.g., FIG. 7) except the low-pressure water discharged from the rotary IPXs 20 into the low-pressure water manifold 118 is fully or partially directed to one or more additional pump trucks 134 for transfer to the well 96 instead of the settling tank 98. For example, the discharged low-pressure water may be directed along fluid conduit 126 to the blender 102 and/or fluid conduit 136 to be provided to the additional pump trucks 136. The additional pump trucks 134 are similar to the pump trucks 90 described above. The pumps on the additional pump trucks 136 pressurize the discharged water and provide the re-pressurized water to the high-pressure fracing fluid flowing from the high-pressure fracing fluid manifold 116 upstream of the well 96. As depicted, the fluid conduit conduits 126 includes a valve 130 to regulate a ratio of the discharged low-pressure water directed to the blender 102 and the additional pump trucks 134, respectively. The ratio of discharged low-pressure water diverted to the blender 102 versus the additional pump trucks 134 may vary. In certain embodiments, the percentage of discharged low-pressure water diverted to the blender 102 (as opposed to upstream of the water pump 110) may range from approximately 75 to 100 percent. For example, the percentage of discharged low-pressure water diverted to the blender 102 may be approximately 75, 80, 85, 90, 95 or 100 percent.

In certain embodiments, the IPX 20 may include features to integrate the IPX 20 within the integrated manifold system 82. For example, as described in greater detail below, the IPX 20 may include a portion of the manifolds (e.g., manifold connectors) and/or one or more valves (e.g., high pressure shut-off valves) integrated or incorporated within the IPX 20 (e.g., within the housing and/or the two end structures 46 and 48 such as manifolds 50 and 52). Integrating the manifold portions (e.g., manifold connectors) and/or the valves into the IPX 20 reduces the amount of metal needed in coupling the IPXs 20 within the integrated manifold system 82. In addition, a reduction in weight, cost, and space is achieved. For the example, the number of valves utilized is reduced. Also, the need for lateral connections to couple the IPXs 20 to the manifolds is reduced or eliminated. In other words, the flow split from the manifold is incorporated within the housing of the IPX 20 as opposed to utilizing a separate three-way connector (e.g., lateral connector) external to the housing of the IPX 20.

Figure 13:
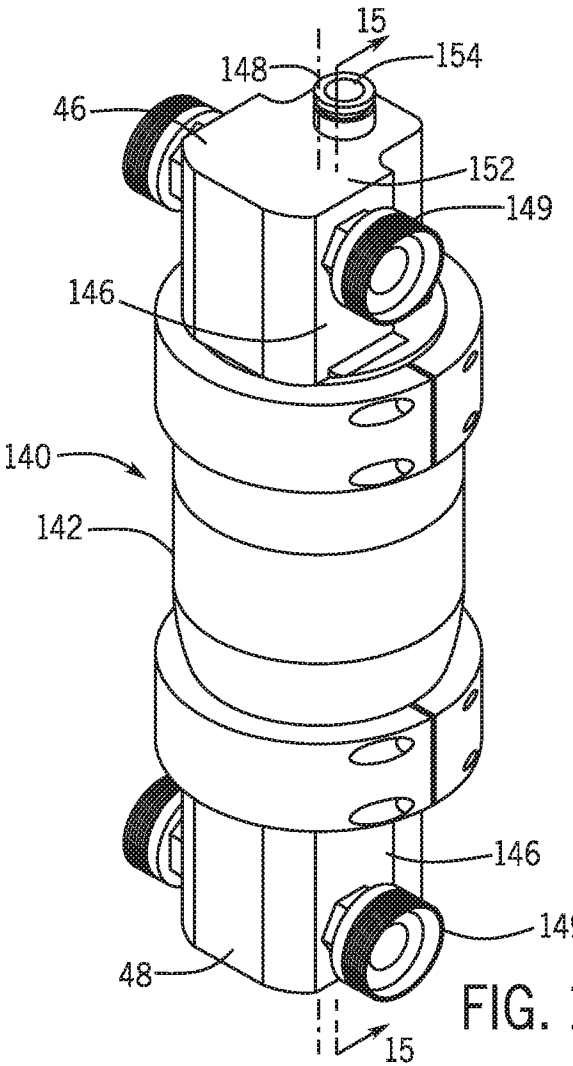
FIG. 13 is a perspective view of an embodiment of the rotary IPX of FIG. 12 having adapters.
Figure 12:
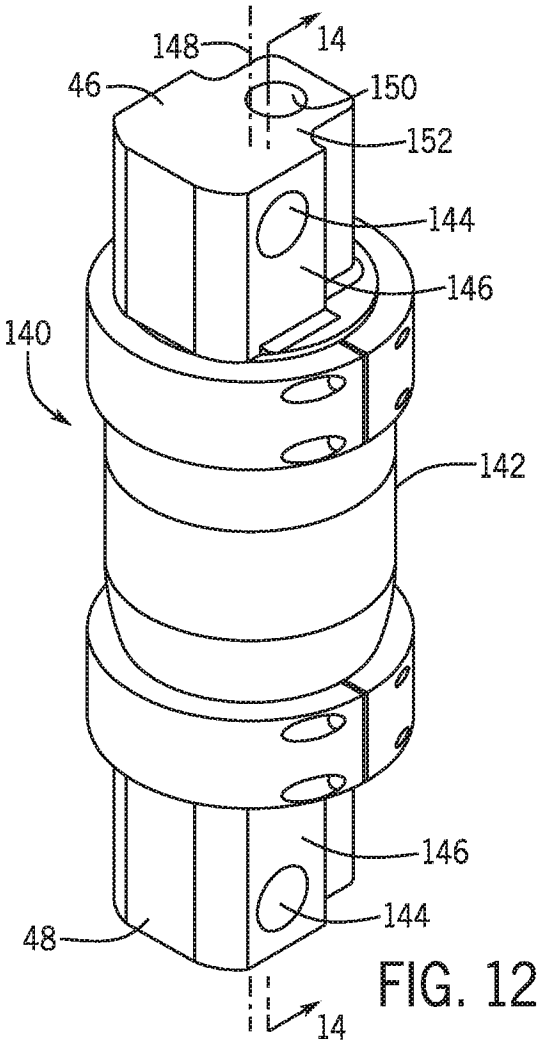
FIG. 12 is a perspective view of an embodiment of the rotary IPX with a portion of a manifold and valves (e.g., high pressure shut-off valves) integrated within the IPX.

FIGS. 12 and 13 are perspective views of embodiments of the rotary IPX 20 with portions of manifolds (e.g., manifold connectors) and valves (e.g., high pressure shut-off valves) integrated within the IPX housing 140. In general, the IPX 20 functions as described above. The housing 140 of the IPX 20 includes an annular portion 142 disposed about the rotor 44 and end structures (or end caps) 46, 48 coupled to each end of the annular portion 142. As described above, the rotor 44 may be disposed within a sleeve 42 and between end covers 62, 64. The end structures 46, 48 each include a high pressure port 144 on each lateral side 146 for high pressure fluid that passes through lateral sides 146 into and/or from the IPX 20. Each port 144 extends crosswise to a longitudinal axis 148 of the IPX 20. As described in greater detail below, a portion of a respective manifold may be disposed within these high pressure ports 144 (i.e., integrated within the IPX 20) enabling the external manifold 84 to be coupled in line with the high pressure ports 144. Each high pressure port 144 is coupled to a high pressure passage disposed within the respective end structure 46, 48 that fluidly interfaces with the rotor ducts (e.g., channels 68). In one end structure 46, 48, the high pressure port 144 and respective high pressure passage serves as an inlet for high pressure fluid (e.g., water) provided to the rotor ducts of the IPX 20. In the other end structure 46, 48, the high pressure port 144 and respective high pressure passage serves as an outlet for high pressure fluid (e.g., fracing fluid) exiting the rotor ducts of the IPX 20. As depicted in FIG. 13, each high pressure port 144 includes a high pressure connector or port adapter 149 coupled to the port 144 (e.g., coupled to each end or threaded portion of the respective portion of the manifold disposed within the IPX 20). As depicted, the high pressure adapter 149 includes a Hammer Union adapter. In certain embodiments, another type of high pressure adapter may be utilized (e.g., a clamp style type fitting).

In FIG. 12, the end structures 46, 48 also each include a low pressure port 150 for low pressure fluid that passes through a respective end face 152 in a direction parallel to the longitudinal axis 148 of the IPX 20. Each low pressure port 150 is coupled to a low pressure passage disposed within the respective end structure 46, 48 that fluidly interfaces with the rotor ducts. In one end structure 46, 48 (e.g., having the high pressure inlet), the low pressure port 150 and respective low pressure passage serve as an outlet for low pressure fluid (e.g., water) exiting the rotor ducts of the IPX 20. In the other end structure 46, 48 (e.g., having the high pressure outlet), the low pressure port 150 and respective low pressure passage serves as an inlet for low pressure fluid (e.g., fracing fluid) entering the rotor ducts of the IPX 20. As depicted in FIG. 13, each low pressure port 150 includes a low pressure connector or port adapter 154 coupled to the port 150. As depicted, the high pressure adapter 154 includes a grooved end adapter such as a Victaulic adapter. In certain embodiments, another type of low pressure adapter may be utilized.

Figure 15:
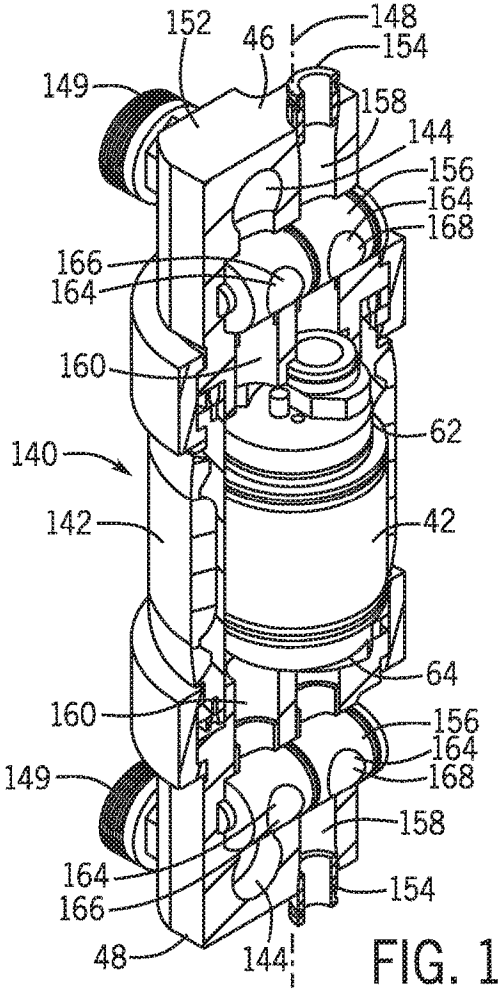
FIG. 15 is a perspective cutaway view of an embodiment of the rotary IPX (e.g., having the high pressure shut-off valves closed) taken along line 15-15 of FIG. 12.
Figure 14:
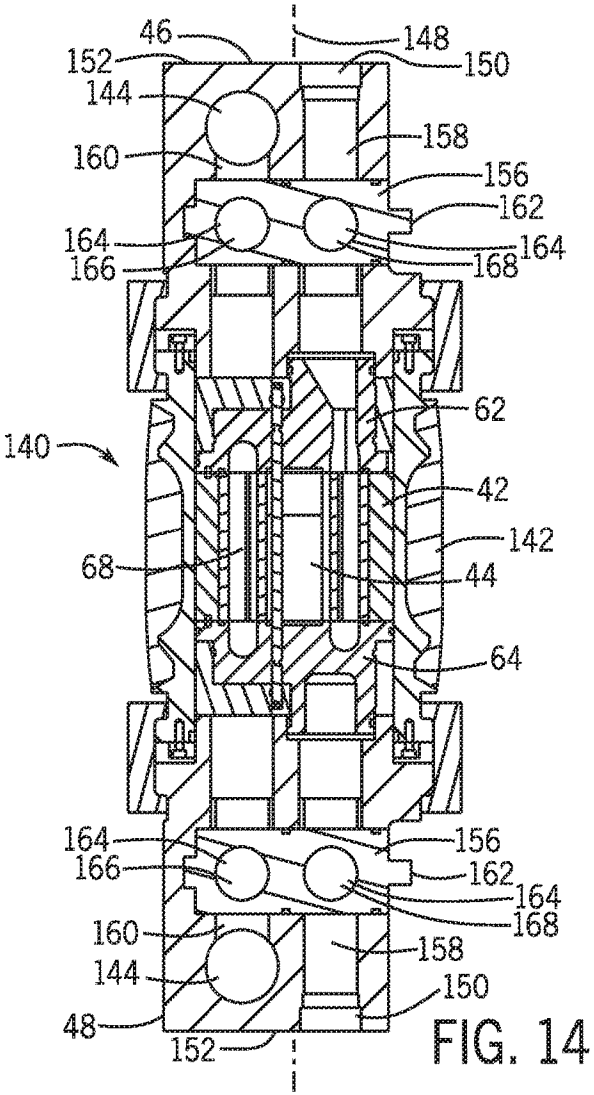
FIG. 14 is perspective cross-sectional view of an embodiment of the rotary IPX (e.g., having the high pressure shut-off valves closed) taken along line 14-14 of FIG. 12.

FIGS. 14 and 15 are different views of the IPX 20 with the high pressure shut-off valves 156 integrated within the IPX 20 (e.g., having the high pressure shut-off valves closed). As depicted in FIGS. 14 and 15, a high pressure shut-off valve 156 is disposed or integrated within the each end structure 46, 48 of the IPX 20. As depicted, the IPX 20 includes two high pressure shut-off valves 156 (e.g., quarter turn double plug valves). In certain embodiments, the IPX 20 may include a different number of high pressure shut-off valves 156. Each high pressure shut off-valve 156 extends crosswise to the longitudinal axis 148 of the IPX 20 across both the respective low pressure passage 158 and high pressure passage 160 within the respective end structure 46, 48. The passages 158, 160 are parallel with the longitudinal axis 148. Each high pressure shut-off valve 156 includes a valve stem 162 extending from the valve 156 and coupled to an actuator or mechanical handle (see FIG. 20). The actuator turns the high pressure shut-off valve 156 a quarter turn between a closed position (as depicted in FIGS. 14 and 15) and an open position. Both of the high pressure shut-off valves 156 may be coupled to a single actuator that controls the valves 156 simultaneously (e.g., via a mechanical linkage coupled to both shut-off valves 156). In other embodiments, the high pressure shut-off valves 156 may be coupled to a respective actuator that controls the respective shut-off valve 156. Each high pressure shut off-valve 156 includes respective ports 164 (e.g., two ports 166, 168 including one for the high pressure passage 160 and one for the low pressure passage 158) that extend through the valve 156 to enable fluid (e.g., high pressure fluid in the high pressure passage 160 and low pressure fluid in the low pressure passage 158) to flow through the passages 158, 160 (and into and out of the rotor ducts) when the ports 166,168 are aligned with the respective passages 160, 158 (i.e., when the shut off-valve 156 is open). As depicted in FIGS. 14 and 15, each high pressure shut off-valve 156 is positioned in the closed position to block flow of fluid (e.g., high pressure fluid in the high pressure passage 160 and low pressure fluid in the low pressure passage 158) occurring through the passages 158, 160 (an into and out of the rotor ducts) to and/or from the low pressure ports 150 and/or the high pressure ports 144 in the respective end structures 46, 48 to the rotor ducts. In the closed position, the ports 166, 168 of the high pressure shut-off valve 156 are not in fluid communication with the passages 158, 160.

Figure 19:
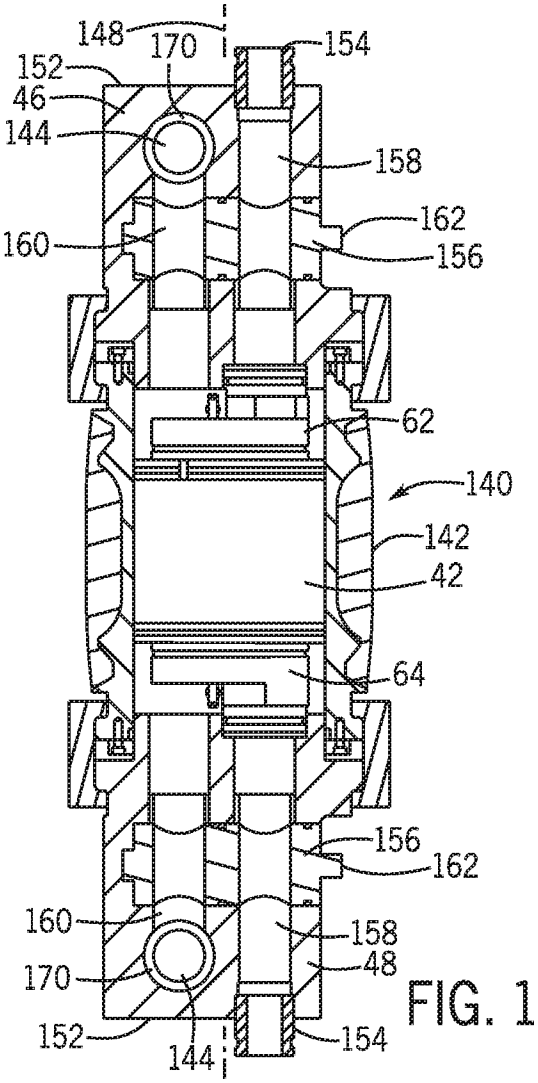
FIG. 19 is a side cross-sectional cutaway view of an embodiment of the rotary IPX (e.g., having the high pressure shut-off valves open) taken along line 15-15 of FIG. 12.
Figure 18:
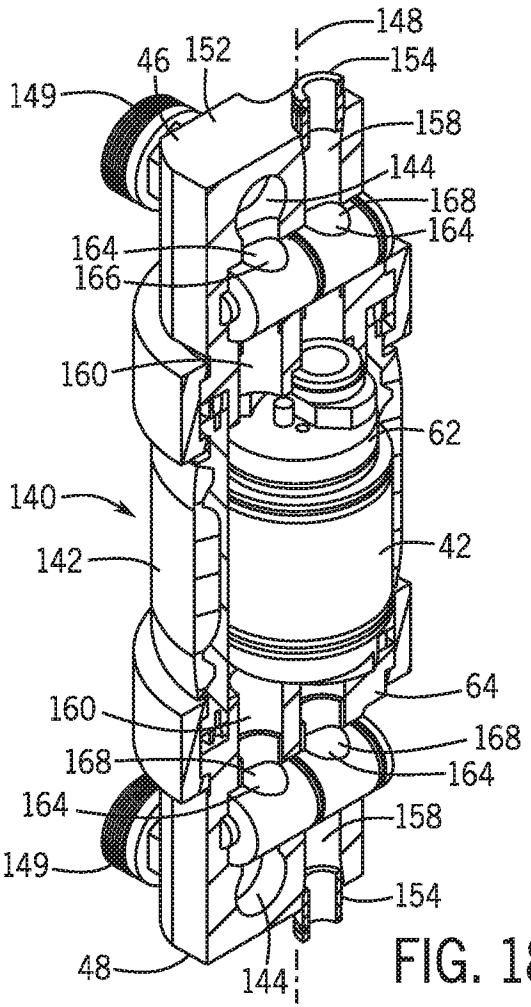
FIG. 18 is a perspective cutaway view of an embodiment of the rotary IPX (e.g., having the high pressure shut-off valves open) taken along line 15-15 of FIG. 12.

FIGS. 16-19 are different views of the IPX 20 with the high pressure shut-off valves 156 integrated within the IPX 20 (e.g., having the high pressure shut-off valves open 156). The IPX 20 and high pressure shut-off valves 156 are as described in FIGS. 14 and 15. As depicted in FIGS. 16-19, the high pressure valves 156 are in an open position. In particular, the respective ports 166, 168 of each high pressure shut off-valve 156 are aligned with the respective passages 160, 158 in the respective end structure 56, 58 to enable fluid (e.g., high pressure fluid in the high pressure passage 160 and low pressure fluid in the low pressure passage 158) to flow through the passages 160, 158 (and into and out of the rotor ducts). Integration of the high pressure shut-off valves 156 into the IPX 20 enables the low pressure port adapters 154 (as opposed to high pressure port adapters 149) to be coupled to the low pressure ports 150 as described above. In the absence of the integrated high pressure shut-off valves 156, high pressure port adapters would need to be coupled to the low pressure ports 150 to enable hydrostatic pressure testing of the IPX 20. As depicted in FIG. 19, the portion of manifold 170 (e.g., forming an internal tee with high pressure passage 160) is integrated within the high pressure ports 144 as described in greater detail below.

Figure 17:
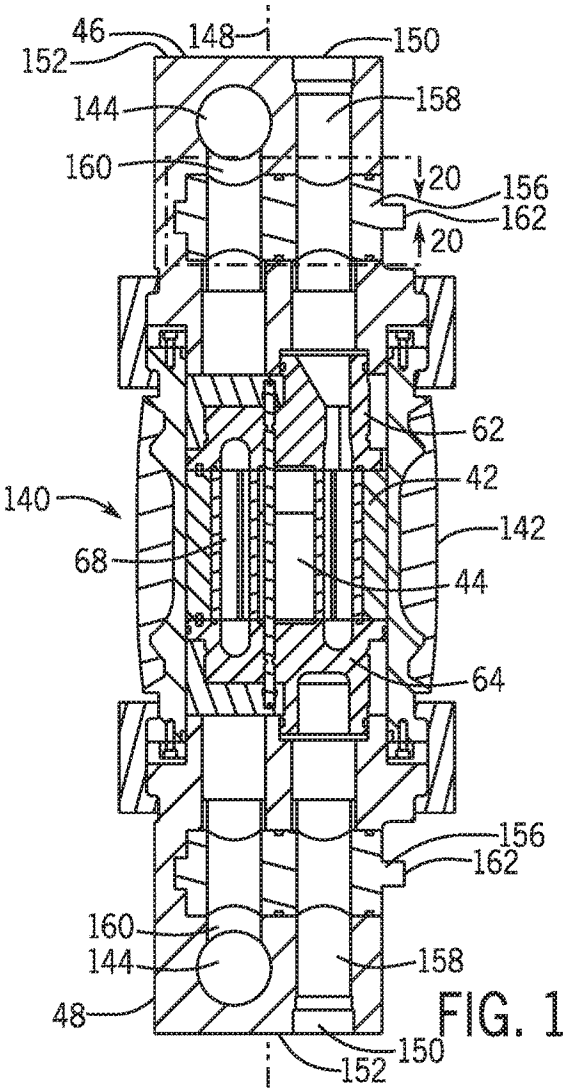
FIG. 17 is a side cross-sectional view of an embodiment of the rotary IPX (e.g., having the high pressure shut-off valves open) taken along line 14-14 of FIG. 12.
Figure 16:
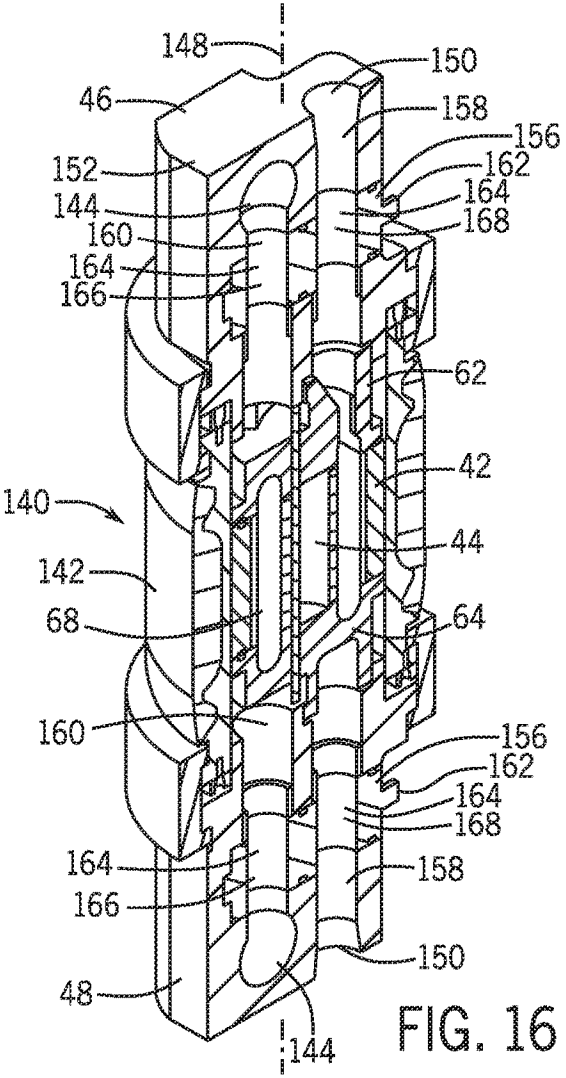
FIG. 16 is a perspective cross-sectional view of an embodiment of the rotary IPX (e.g., having the high pressure shut-off valves open) taken along line 14-14 of FIG. 12.
Figure 20:
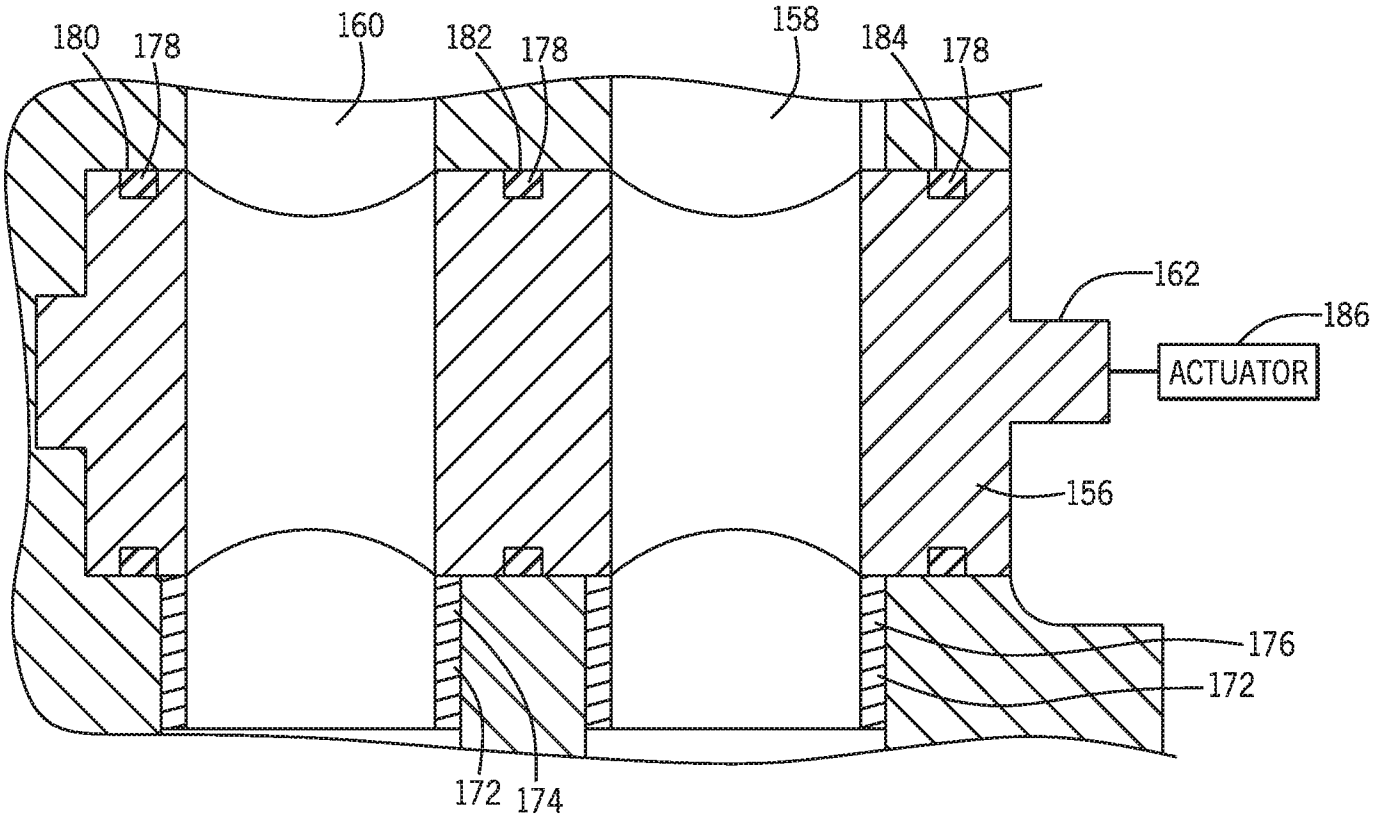
FIG. 20 is a side cross-sectional view of an embodiment of a high pressure shut-off valve integrated within the rotary IPX taken within line 20-20 of FIG. 17.

FIG. 20 is a side cross-sectional view of an embodiment of the high pressure shut-off valve 156 (e.g., quarter turn double plug valve) integrated within the rotary IPX 20 taken within line 20-20 of FIG. 17. As depicted in FIG. 20 (and also shown in FIGS. 14-19), each high pressure shut-off valve 156 abuts multiple valve seats 172 disposed within the passages 158, 160. For example, in each end structure 46, 48 a respective valve seat 174, 176 is disposed within the high pressure passage 160 and the low pressure passage 158. Specifically, the valves seats 174, 176 are disposed within the passages 160, 158 between the high pressure shut-off valves 156 and the rotor 44. The valve seats 174, 176 block leakage from the passages 160, 158. In addition, multiple seals 178 (e.g., radial or annular seals) are disposed about each high pressure shut-off valve 156 to block leakage of fluid between the low pressure 158 and high pressure passages 160. For example, a first seal 180 is disposed about the shut-off valve 156 adjacent a side of the high pressure passage 160 opposite the low pressure passage 158. In addition, a second seal 182 is disposed about the shut-off valve 156 between both the high pressure 160 and low pressure passages 158. Further, a third seal 184 is disposed about the shut-off valve 156 adjacent a side of the low pressure passage 158 opposite the high pressure passage 160. Thus, a pair of seals 178 flank both the high pressure passage 160 and the low pressure passage 158. In certain embodiments, a different number of seals 178 may be utilized in conjunction with the high pressure shut-off valves 156. As depicted, the valve stem 162 of the high pressure-shut off valve 156 is coupled to an actuator 186 as described above.

Figure 21:
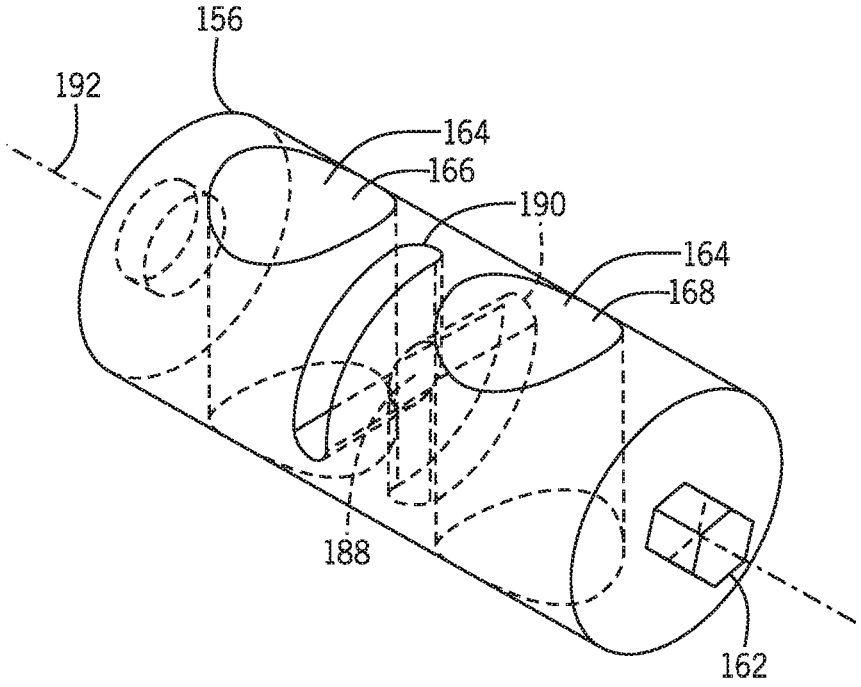
FIG. 21 is a perspective view of an embodiment of a high pressure shut-off valve.

In certain embodiments, the IPX 20 may include a motor. FIG. 21 is a perspective view of an embodiment of a high pressure shut-off valve 156 configured for use with an IPX 20 that includes a motor. An IPX 20 that includes a motor may include a drive shaft that extends (e.g., parallel to the longitudinal axis of the IPX 20) through at least a portion of the IPX 20 and its housing 140. In general, the high pressure shut-off valve 156 is as described above. In addition, as depicted in FIG. 21, the shut-off valve includes a passage 188 for the shaft to pass through the shut-off valve 156. The passage 188 is disposed between the two ports 166, 168 of the shut-off valve 156. Two cutouts 190 partially extend in both a circumferential and radial direction (relative to a longitudinal axis 192 of the shut-off valve 156) into the shut-off valve 156 to define the passage 188 for the shaft. The cutouts 190 enable the shut-off valve 156 to rotate with a quarter turn between the closed and open positions while the shaft extends through the shut-off valve 156.

Figure 22:
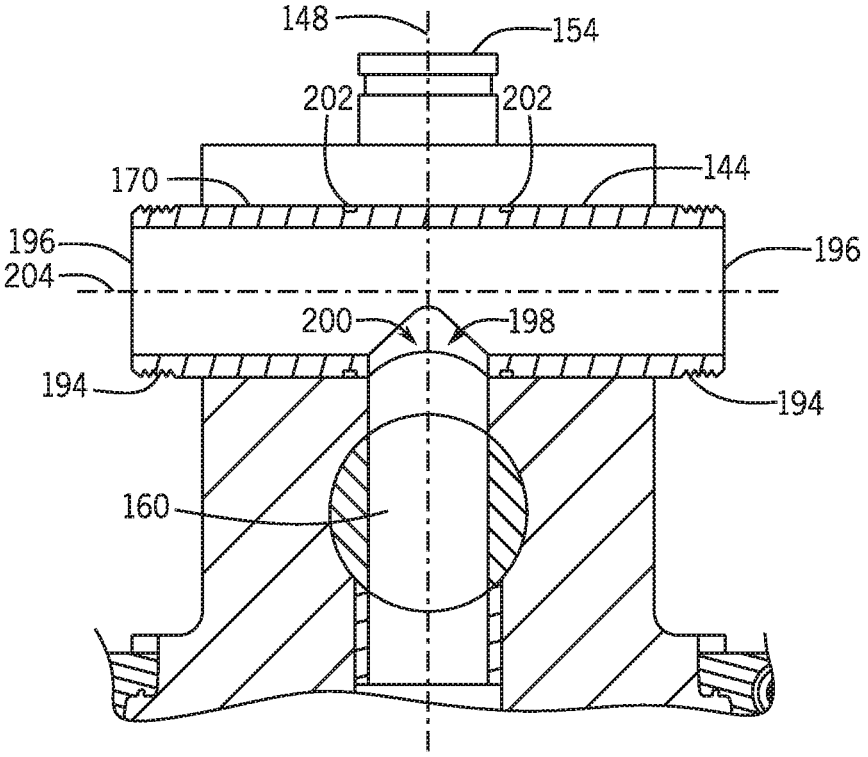
FIG. 22 is a side cross-sectional view of an embodiment of a portion of a manifold integrated within a rotary IPX.
Figure 23:
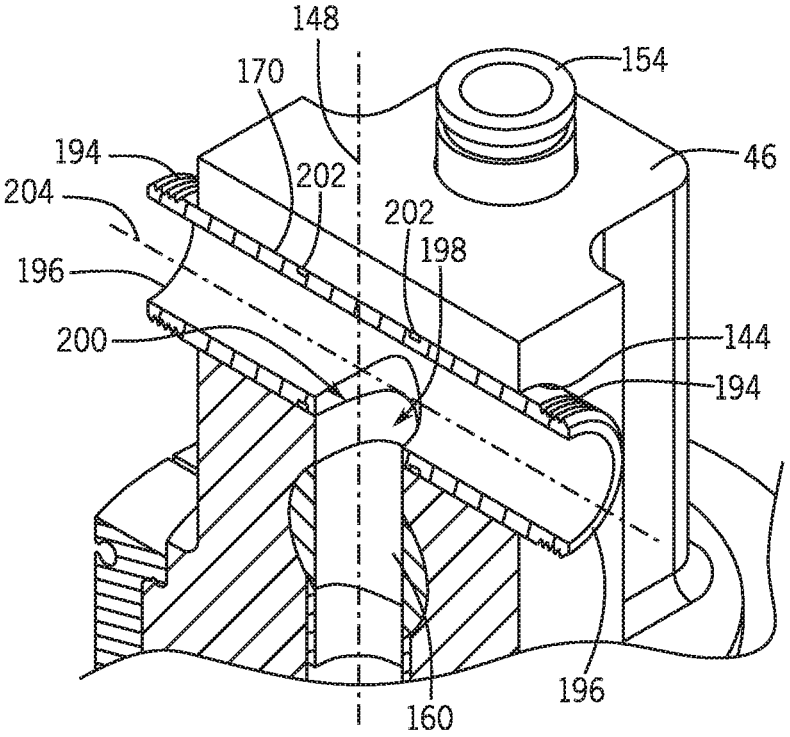
FIG. 23 is a perspective cross-sectional of an embodiment of the portion of the manifold integrated within the rotary IPX of FIG. 21.

As mentioned above, portions of the manifold 170 (e.g., manifold connections) may be integrated within the housing 140 of the IPX 20. FIGS. 22 and 23 are cross-sectional views of an embodiment of the portion of a manifold 170 integrated within the IPX 20. A single end structure (e.g., end structure 46) of the IPX 20 is shown in FIGS. 22 and 23, but the below description also applies to the other end structure 48. The end structure 46 includes a nipple 170 (e.g., manifold portion or manifold connection) disposed through the high pressure port 144. In certain embodiments, the nipple 170 includes a threaded portion 194 on each end 196 configured to couple to high pressure port adapters 149 as described above. As depicted, the threaded portions 194 are disposed outside of the end structure 46 enabling the high pressure port adapters 149 (e.g., Hammer Union or other high pressure connector) to couple to the IPX 20 outside of the housing 140. The manifold pipes 84 (e.g., for high pressure fluid) may then couple to the IPX 20 via the high pressure port adapters 149. As depicted in FIGS. 22 and 23, the nipple 170 includes a port or opening 198 that aligns with the high pressure passage 160 to enable flow of the high pressure fluid to (e.g., for the high pressure inlet) or from (e.g., for the high pressure outlet) the rotor 44 of the IPX 20. The nipple 170 with the port aligned with the high pressure passage 160 forms an internal tee 200 for the flow of the high pressure fluid. In addition, multiple seals 202 (e.g., radial or annular seals) are disposed about the nipple 170. As depicted, a pair of seals 202 flank the port or opening 198 of the nipple 170 that diverts fluid flow to or from the high pressure passage 160. The nipple 170 allows for axial movement relative to longitudinal axis 204 of the nipple 170 (e.g., crosswise to the longitudinal axis 148) through the high pressure port 144 of the end structure 46 to compensate for any misalignments between the housing 140 and connector pipe (e.g., manifold pipe 84) length. The nipple 170 is also configured to be removed and replaced with another nipple (e.g., due to wear). This connection technique avoids any axial misalignments between piping and the housing 142 that could cause pipe strain to be put on the housing 142 if the port adapters 149 were threaded or coupled within the housing 142. In addition, this connection technique (i.e., the internal nipple with the external threaded portions) reduces the force applied to the housing 142 of the IPX 20.

Figure 24:
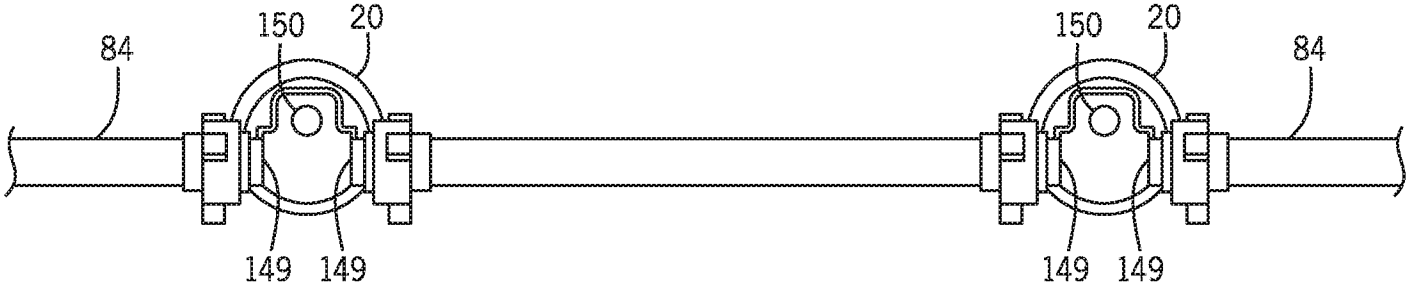
FIG. 24 is a side view of an embodiment of rotary IPXs coupled to manifolds.

FIG. 24 is a side view of an embodiment of rotary IPXs 20 coupled to manifolds 84. One of benefits of the internal tee or manifold portion 170 integrated within the IPX 20 is that the IPXs 20 may be coupled in line to manifold pipes 84 (e.g., high pressure manifold pipes) of the manifold trailer. This in line coupling minimizes the space occupied by coupling the IPXs to the manifold system. As depicted in FIG. 24, the manifold pipes 84 are coupled to the IPXs 20 via high pressure connectors 149 (as described above) that are coupled to the internal manifold portions 170 (e.g., nipples). The distance 206 of the manifold pipe 84 (and thus between adjacent IPXs 20) between the IPXs 20 may vary within the integrated manifold system.

Figure 25:
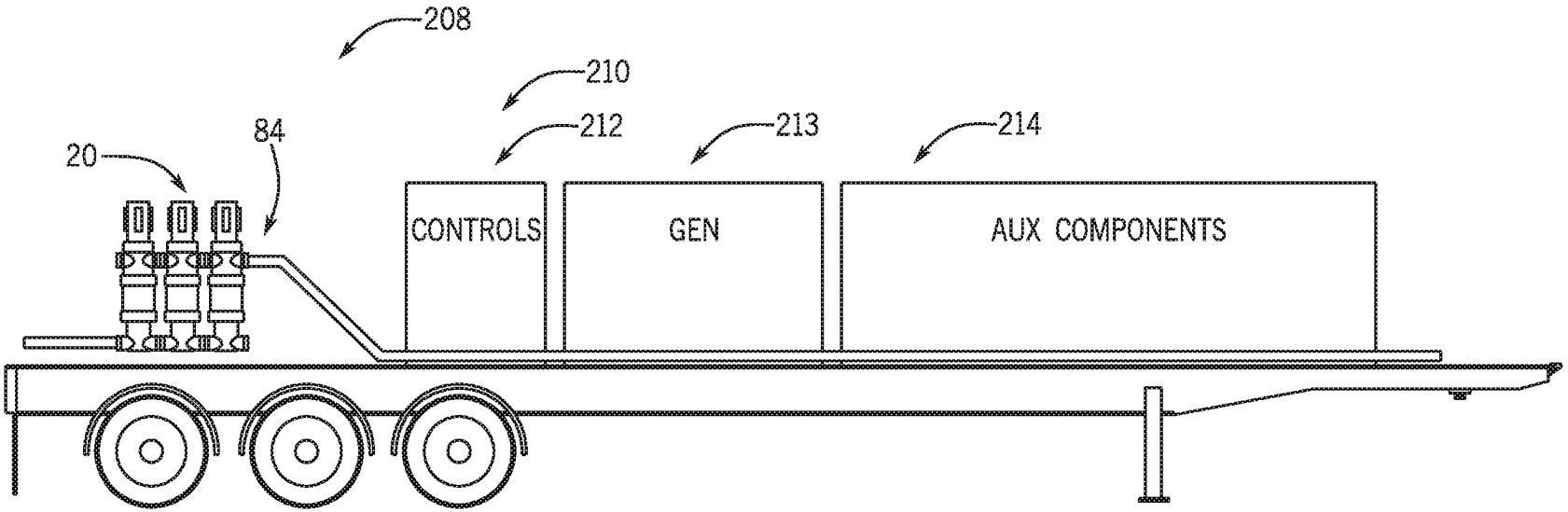
FIG. 25 is a side view of an embodiment of an integrated manifold system disposed on a mobile trailer.
Figure 26:
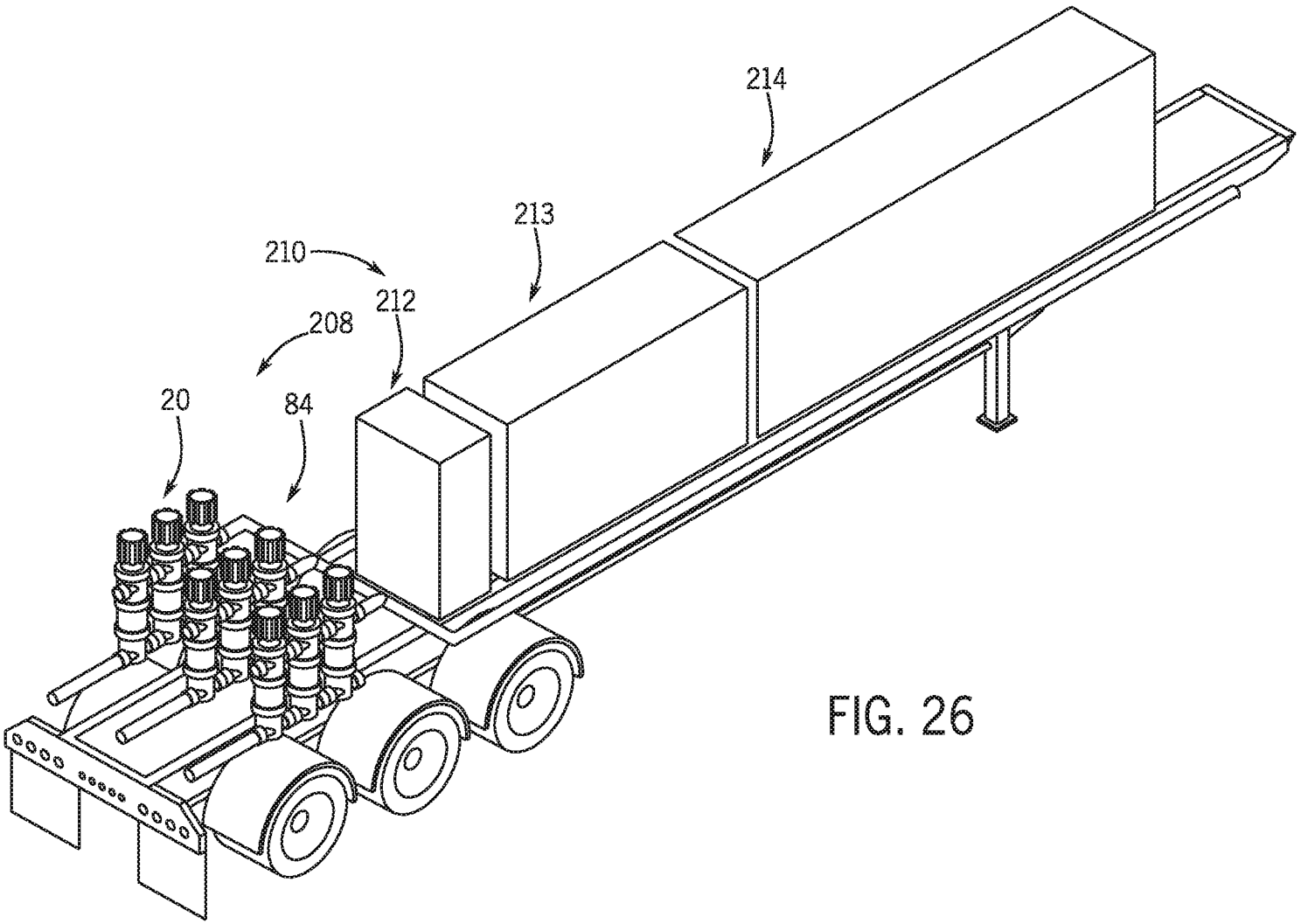
FIG. 26 is a perspective view of an embodiment of an integrated manifold system disposed on a mobile trailer.
Figure 27:
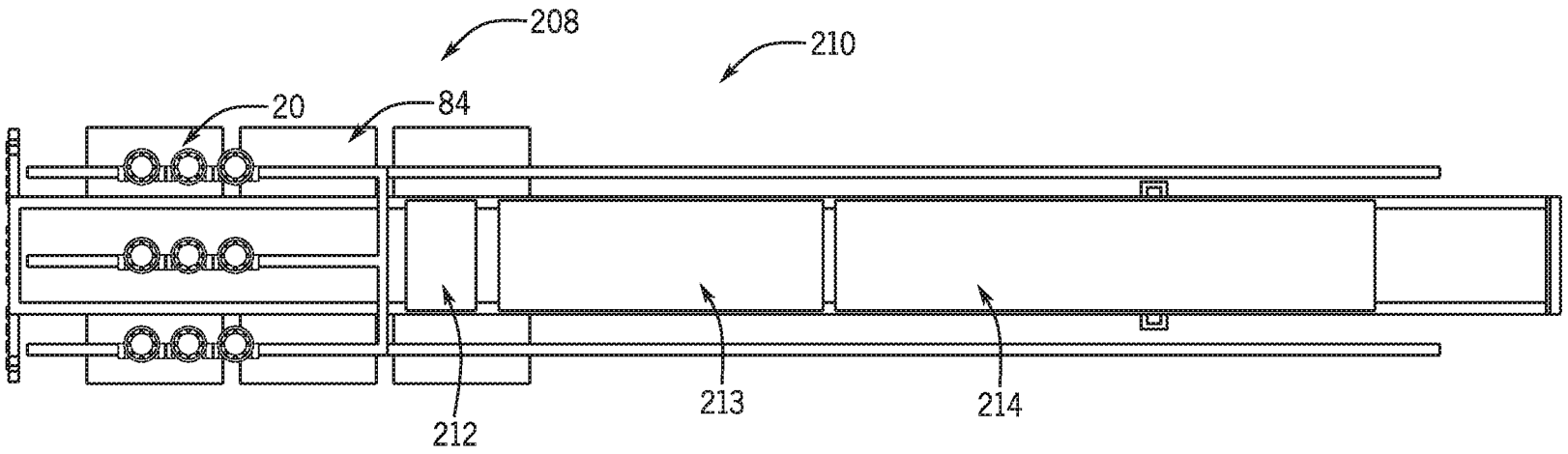
FIG. 27 is a top view of an embodiment of an integrated manifold system disposed on a mobile trailer.

FIGS. 25-27 are different views of an embodiment of an integrated manifold system 208 disposed on a mobile trailer 210. As mentioned above, the integration of the manifold portions 170 and the valves 156 within the IPX 20 enables the housings 140 of the IPXs 20 to be located closer together. This enables integrated manifold system 208 to have a smaller footprint. In particular, as depicted in FIGS. 25-27, the IPXs 20 and the manifold 84 can be disposed along with the controls 212, power generator 213, and support unit 214 (e.g., auxiliary components) for the integrated manifold system 208 on the mobile trailer 210 or missile. With the components disposed on the same trailer, many connections may be eliminated (e.g., hoses from the support unit to the missile). In addition, the blender may now hook straight to the missile. Further, the high pressure outlets may disposed at the very of the trailer to reduce the iron by half. Even further, the high pressure inlet manifold may begin at a lower height to make it easier to connect to the pump trucks and then rise up to the high pressure inlet manifold. Still further, better flow distribution may be achieved in the integrated manifold system (e.g., all of the flow from the high pressure inlet is collected and then distributed at the end of the pipeline rather than along the way). As mentioned above, pipe strain may also be significantly reduced. For example, the connector nipples inside the housings will be joined directly together (e.g., via safety clamps) and enabled to move axially within the housing. Also, each row of three IPXs 20 will be mounted on the same beam support which should help in aligning their ports. Further, since the low pressure ports 150 are valved off internally, low pressure victaulics and flexible hoses can be used, which will not impart pipe strain. In certain embodiments, a compact crane can be installed near the IPXs 20 to aid servicing. In certain embodiments, a drop trailer can be used to make the connections even lower to the ground.

While the subject matter may be susceptible to various modifications and alternative forms, specific embodiments have been shown by way of example in the drawings and have been described in detail herein. However, it should be understood that the subject matter is not intended to be limited to the particular forms disclosed. Rather, the subject matter is to cover all modifications, equivalents, and alternatives falling within the spirit and scope of the subject matter as defined by the following appended claims.

What is claimed is:

1. A system, comprising:

an isobaric pressure exchanger (IPX) configured to couple to a manifold and to exchange pressure within the IPX between a first liquid at a first pressure and a second liquid at a second pressure, wherein the IPX comprises:

a housing comprising an annular portion, a first end structure, and a second end structure, wherein the first and second end structures are coupled to opposite ends of the annular portion;

at least one manifold connector disposed within the first end structure or the second end structure and is configured to couple the IPX to the manifold, wherein the at least one manifold connector comprises a first end, a second end, a central portion between the first end and the second end, and wherein the first end comprises a first threaded portion, the second end comprises a second threaded portion, the first and second threaded portions are disposed outside of the housing, and the central portion is disposed within the housing; and at least one high pressure shut-off valve disposed within the first end structure or the second end structure, wherein the at least one high pressure shut-off valve extends crosswise relative to a longitudinal axis of the IPX within the first end structure or the second end structure, and wherein the at least one high pressure shut-off valve extends across both a low pressure liquid passage and a high pressure liquid passage within the first end structure or the second end structure.

2. The system of claim 1, wherein the at least one manifold connector of the IPX comprises a first manifold connector disposed within the first end structure and a second manifold connector disposed within the second end structure.

3. The system of claim 1, wherein the IPX comprises a rotor disposed within the annular portion between the first and second end structures.

4. The system of claim 1, wherein the at least one manifold connector extends crosswise relative to the longitudinal axis of the IPX within the first end structure or the second end structure.

5. The system of claim 1, wherein the at least one manifold connector is disposed within a high pressure port.

6. The system of claim 5, wherein the high pressure port is coupled to the high pressure liquid passage within the IPX that extends along the longitudinal axis of the IPX, and the at least one manifold connector comprises an opening that is aligned within the high pressure liquid passage to enable the at least one manifold connector and the high pressure liquid passage to form an internal tee within the IPX.

7. The system of claim 5, wherein the at least one manifold connector is configured to move axially within the high pressure port when coupled to the manifold.

8. The system of claim 1, comprising a first port adapter coupled to the first threaded portion and a second port adapter coupled to the second threaded portion, and both the first and second threaded portions are configured to couple the at least one manifold connector to the manifold to reduce a force applied to the housing.

9. A system, comprising:

an isobaric pressure exchanger (IPX) configured to couple to a manifold and to exchange pressure within the IPX between a first liquid at a first pressure and a second liquid at a second pressure, wherein the IPX comprises:

a housing comprising an annular portion, a first end structure, and a second end structure, wherein the first and second end structures are coupled to opposite ends of the annular portion; and at least one high pressure shut-off valve disposed within the first end structure or the second end structure, wherein the at least one high pressure shut-off valve extends crosswise relative to a longitudinal axis of the IPX within the first end structure or the second end structure, and wherein the at least one high pressure shut-off valve extends across both a low pressure liquid passage and a high pressure liquid passage within the first end structure or the second end structure.

10. The system of claim 9, wherein the at least one high pressure shut-off valve of the IPX comprises a first high pressure shut-off valve disposed within the first end structure and a second high pressure shut-off valve disposed within the second end structure.

11. The system of claim 9, wherein the IPX comprises a rotor disposed within the annular structure between the first and second end structures.

12. The system of claim 9, wherein the high pressure shut-off valve abuts both a first valve seat disposed within the low pressure liquid passage and a second valve seat disposed within the high pressure liquid passage.

13. The system of claim 12, wherein the at least one high pressure shut-off valve comprises a first port aligned with the low pressure liquid passage and a second port aligned with the high pressure liquid passage, and wherein when the at least one high pressure shut-off valve is in a first position liquid is blocked from flowing through the first and second ports from the low pressure liquid passage and the high pressure liquid passage, respectively, and when the at least one high pressure shut-off valve is in a second position liquid is allowed to flow through the first and second ports from the low pressure liquid passage and the high pressure liquid passage, respectively.

14. The system of claim 13, wherein the at least one high pressure shut-off valve is configured to rotate a quarter turn and comprises two plugs.

15. A system, comprising:

an isobaric pressure exchanger (IPX) configured to couple to a manifold and to exchange pressure within the IPX between a first liquid at a first pressure and a second liquid at a second pressure, wherein the IPX comprises:

a housing comprising an annular portion, a first end structure, and a second end structure, wherein the first and second end structures are coupled to opposite ends of the annular structure;

a first manifold connector disposed within the first end structure;

a second manifold connector disposed within the second end structure, wherein the first and second manifold connectors are configured to couple the IPX to the manifold;

a first high pressure shut-off valve disposed within the first end structure; and a second high pressure shut-off valve disposed within the second end structure, wherein the first and second high pressure shut-off valves are configured to control a flow of high pressure liquid into and out of the IPX via the first and second manifold connectors, and wherein the first high pressure shut-off valve extends crosswise relative to a longitudinal axis of the IPX within the first end structure, the second high pressure shut-off valve extends crosswise relative to the longitudinal axis of the IPX within the second end structure, the first high pressure shut-off valve extends across both a first low pressure liquid passage and a first high pressure liquid passage within the first end structure, and the second high pressure shut-off valve extends across both a second low pressure liquid passage and a second high pressure liquid passage within the second end structure;

wherein the first manifold connector or the second manifold connector comprises a first end, a second end, a central portion between the first end and the second end, and wherein the first end comprises a first threaded portion, the second end comprises a second threaded portion, the first and second threaded portions are disposed outside of the housing, and the central portion is disposed within the housing.

* * * * *